US012780521B2

(12) United States Patent
Lange et al.

(10) Patent No.: US 12,780,521 B2
(45) Date of Patent: Nov. 3, 2026

(54) CONTAINER FOR CONSUMER GOODS HAVING HOUSING AND OUTER WRAPPER

(71) Applicant: Philip Morris Products S.A., Neuchatel (CH)

(72) Inventors: Ross Lange, Neuchâtel (CH); Alexander Androsenko, Boudry (CH); Cesare Lorenzetti, Boudry (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/856,784

(22) PCT Filed: Jun. 13, 2023

(86) PCT No.: PCT/EP2023/065849
§ 371 (c)(1),
(2) Date: Oct. 14, 2024

(87) PCT Pub. No.: WO2023/242214
PCT Pub. Date: Dec. 21, 2023

(65) Prior Publication Data

US 2025/0250085 A1 Aug. 7, 2025

(30) Foreign Application Priority Data

Jun. 13, 2022 (EP) ..... 22178748

(51) Int. Cl.
*B65D 77/00* (2006.01)
*B65B 11/00* (2006.01)
(Continued)

(52) U.S. Cl.
CPC ..... *B65D 77/003* (2013.01); *B65B 11/004* (2013.01); *B65B 51/10* (2013.01); *B65D 77/30* (2013.01); *B65D 85/1045* (2013.01)

(58) Field of Classification Search
CPC ..... B65B 11/00; B65B 11/004; B65B 19/228; B65B 51/10; B65D 75/12; B65D 75/28;
(Continued)

(56) References Cited

U.S. PATENT DOCUMENTS 1,264,497 A * 4/1918 Field ..... B65D 85/36 206/245
3,333,683 A * 8/1967 Scharre ..... B65D 85/1027 229/87.13
(Continued)

FOREIGN PATENT DOCUMENTS

CN 109890728 A 6/2019
DE 101 29 925 A1 1/2003
(Continued)

OTHER PUBLICATIONS

Extended European Search Report issued Nov. 25, 2022 in European Patent Application No. 22178748.4, 7 pages.
(Continued)

*Primary Examiner* — Bryon P Gehman
(74) *Attorney, Agent, or Firm* — Oblon, McClelland, Maier & Neustadt, L.L.P.

(57) ABSTRACT

A container for consumer goods is provided, the container including: a housing configured for consumer goods; an outer wrapper having an inner surface and an outer surface, the outer wrapper including a cellulose based layer, the outer wrapper being wrapped around the housing such that a first portion of the outer wrapper overlies a second portion of the outer wrapper at a first end of the housing to cover the first end of the housing, the first portion of the outer wrapper forming a rectangular fold, the outer wrapper further including a heat-sealable polymeric layer provided at least on the inner surface of the first portion of the outer wrapper, and the heat-sealable polymeric layer being sealed onto the first end
(Continued)

of the housing. A method of forming a container for consumer goods is also provided.

26 Claims, 6 Drawing Sheets

(51) Int. Cl.
*B65B 51/10* (2006.01)
*B65D 77/30* (2006.01)
*B65D 85/10* (2006.01)

(58) Field of Classification Search
CPC .... B65D 75/58; B65D 75/5844; B65D 77/00; B65D 77/003; B65D 77/30; B65D 85/10; B65D 85/1027; B65D 85/1045
USPC ..... 206/245, 264–275; 229/87.01–87.15
See application file for complete search history.

(56) References Cited

U.S. PATENT DOCUMENTS

| | | | |
|---|---|---|---|
| 3,463,659 | A | 8/1969 | Dragoon et al. |
| 2019/0263556 | A1 | 8/2019 | Cailleaux et al. |
| 2019/0367235 | A1 | 12/2019 | Holford |

FOREIGN PATENT DOCUMENTS

| | | | | |
|---|---|---|---|---|
| RU | 2129080 | C1 | 4/1999 | |
| RU | 2715790 | C1 | 3/2020 | |
| RU | 2765199 | C1 | 1/2022 | |
| WO | WO-2012085196 | A1 * | 6/2012 | ..... B65D 75/58 |
| WO | WO 2012/175621 | A1 | 12/2012 | |
| WO | WO 2014/195008 | A2 | 12/2014 | |
| WO | WO 2018/134593 | A1 | 7/2018 | |
| WO | WO-2020039184 | A1 * | 2/2020 | ..... B65D 77/003 |
| WO | WO 2021/023661 | A1 | 2/2021 | |
| WO | WO 2022/012961 | A2 | 1/2022 | |
| WO | WO 2023/006928 | A1 | 2/2023 | |

OTHER PUBLICATIONS

International Search Report & Written Opinion issued Sep. 18, 2023 in PCT/EP2023/065849, filed on Jun. 13, 2023, 10 pages.
International Preliminary Report on Patentability issued Aug. 30, 2024 in PCT/EP2023/065849, filed on Jun. 13, 2023, 16 pages.
Notice of Allowance and Search Report dated Jul. 29, 2026 issued in corresponding Russian Patent Application No. 2025100066.
Office Action and Search Report dated Aug. 15, 2026 issued in corresponding Chinese Patent Application No. 202380039274.9 (with English translation).

* cited by examiner

105 = 51
104 = 29
23
10
21

10
23
103 = 28

102 = 27
24
101

103 = 28
102 = 27
24
101
21
10
22
19′

101
24
19′
10
17

10
101

10
101

101, 101′, 701, 801
73
74
19′

10
71
101, 101′, 701, 801
73
74
19′

22
19′
10

CONTAINER FOR CONSUMER GOODS HAVING HOUSING AND OUTER WRAPPER

The present invention relates to a container for consumer goods and a method for forming a container for consumer goods. Containers according to the invention find particular application as containers for aerosol-generating articles or components of aerosol-generating articles.

It is generally known to package aerosol-generating articles or other consumer goods in containers formed from folded cellulose-fiber based laminar blanks. Aerosol-generating articles, such as for example cigarettes, are commonly sold in hinge-lid packs having a box for housing the aerosol-generating articles and a lid connected to the box about a hinge line to open the pack and so gain access to the aerosol-generating articles held in the box.

It is also known to package consumer goods in containers having housing around which an outer wrapper is wrapped to provide additional protection to the consumer goods in which the consumer goods are housed.

One type of aerosol-generating article is a cigarette or a cigar. These typically comprise a rod of tobacco cut filler surrounded by a paper wrapper and a cylindrical filter aligned in an end-to-end relationship with the wrapped tobacco rod, with the filter attached to the tobacco rod by tipping paper.

Other types of aerosol-generating articles include those in which an aerosol-forming substrate, such as tobacco, is heated rather than combusted. For example, electrically operated smoking systems typically include an aerosol-generating device having a housing for receiving an aerosol-generating article or a smoking article. A charger unit is usually provided either integrally with a primary device for receiving the aerosol-generating device or additionally to a primary device for receiving the aerosol-generating device. The charger unit is used to provide power to the aerosol-generating device, for example by charging a battery in the device.

It is generally desirable to provide a container with a barrier between the consumer goods in the housing and moisture or the ingress of other outside elements which could damage or spoil the consumer goods. For example, a plastic outer wrapper may be provided to provide such a barrier between the consumer goods and the outside environment. However, such plastic packaging solutions, which involve generally single use of non-recyclable plastics, are currently a major issue in the packaging industry. This is due to the increased sensitivity to environmental issue and an increased demand for more sustainable packaging alternatives. More recently, cellulose based outer wrappers have been adopted which are provided with a heat sealable coating to seal the consumer goods within the container. However, such cellulose based wrappers require a relatively large amount of heat sealable coating and require complex folds to ensure adequate sealing of the container is achieved.

It would therefore be desirable to provide a container for consumer goods of the type described above having an improved solution for a more environmentally friendly packaging solution without suffering from the abovementioned drawbacks.

The present disclosure relates to a method of forming a container for consumer goods. The method may comprise the steps of: providing a housing for consumer goods; providing an outer wrapper, the outer wrapper comprising a cellulose based layer, wherein a heat sealable polymeric layer may be provided at least on an inner surface of a first portion of the outer wrapper; folding the outer wrapper around the housing such that a first portion of the outer wrapper overlies a second portion of the outer at a first end of the housing to cover the first end; heating the housing and the outer wrapper to seal the outer wrapper on the housing.

The present disclosure also relates to a container for consumer goods. The container may comprise a housing for consumer goods. The container may comprise an outer wrapper. The outer wrapper may have an inner surface and an outer surface. The outer wrapper may comprise a cellulose based layer. The outer wrapper may be wrapped around the housing such that a first portion of the outer wrapper overlies a second portion of the outer wrapper at a first end of the housing. The first portion may overlie the second portion to cover the first end of the housing. The first portion of the outer wrapper may form a rectangular fold. The outer wrapper may further comprise a heat sealable polymeric layer. The heat sealable polymeric layer may be provided at least on the inner surface of the first portion of the outer wrapper for sealing the outer wrapper at the first end of the housing.

According to the invention there is provided a method of forming a container for consumer goods, the method comprising the steps of: providing a housing for consumer goods; providing an outer wrapper, the outer wrapper comprising a cellulose based layer, wherein a heat sealable polymeric layer is provided at least on an inner surface of a first portion of the outer wrapper; folding the outer wrapper around the housing such that the first portion of the outer wrapper overlies a second portion of the outer wrapper at a first end of the housing to cover the first end of the housing, wherein the first portion forms a rectangular fold; heating the housing and the outer wrapper to seal the outer wrapper on the housing. The method may include the step of folding a sheet to form the housing.

According to the invention there is also provided a container for consumer goods, the container comprising: a housing for consumer goods; an outer wrapper having an inner surface and an outer surface, the outer wrapper comprising a cellulose based layer; wherein the outer wrapper is wrapped around the housing such that a first portion of the outer wrapper overlies a second portion of the outer wrapper at the first end of the housing to cover the first end of the housing; wherein the first portion of the outer wrapper forms a rectangular fold; and wherein the outer wrapper further comprises a heat sealable polymeric layer provided at least on the inner surface of the first portion of the outer wrapper for sealing the outer wrapper at the first end of the housing.

According to the invention there is also provided a method of forming a container for consumer goods, the method comprising the steps of providing a housing for consumer goods, an outer wrapper having an inner surface and an outer surface, the outer wrapper comprising a cellulose based layer; wherein the outer wrapper is wrapped around the housing such that a first portion that depends from a fold line of a first wall of the outer wrapper overlies a second portion of the outer wrapper at a first end of the housing to cover the first end of the housing; wherein the first portion fully overlies the first end of the housing; wherein the first portion of the outer wrapper forms a rectangular fold; and wherein the outer wrapper further comprises a heat sealable polymeric layer provided at least on the inner surface of the first portion of the outer wrapper for sealing the heat sealable polymeric layer at the first end of the housing.

According to the invention there is also provided a container for consumer goods, the container comprising: a housing for consumer goods; an outer wrapper having an inner surface and an outer surface, the outer wrapper comprising a cellulose based layer; wherein the outer wrapper is wrapped around the housing such that a first portion that depends from a fold line of a first wall of the outer wrapper overlies a second portion of the outer wrapper at a first end of the housing to cover the first end of the housing; wherein the first portion fully overlies the first end of the housing; wherein the first portion of the outer wrapper forms a rectangular fold; and wherein the outer wrapper further comprises a heat sealable polymeric layer provided at least on the inner surface of the first portion of the outer wrapper for sealing the heat sealable polymeric layer at the first end of the housing.

According to the invention there is also provided a method of forming a container for consumer goods, the method comprising the steps of providing a housing for consumer goods; an outer wrapper having an inner surface and an outer surface, the outer wrapper comprising a cellulose based layer; wherein the outer wrapper is wrapped around the housing such that a first portion that depends from a fold line of a first wall of the outer wrapper overlies a second portion of the outer wrapper at a first end of the housing to cover the first end of the housing; wherein the first portion fully overlies the first end of the housing; wherein the first portion of the outer wrapper forms a rectangular fold; and wherein the outer wrapper further comprises a heat sealable polymeric layer provided at least on the inner surface of the first portion of the outer wrapper for sealing the heat sealable polymeric layer at the first end of the housing.

According to the invention there is also provided a container for consumer goods, the container comprising: a housing for consumer goods; an outer wrapper having an inner surface and an outer surface, the outer wrapper comprising a cellulose based layer; wherein the outer wrapper is wrapped around the housing such that a first portion that depends from a fold line of a first wall of the outer wrapper overlies a second portion of the outer wrapper at a first end of the housing to cover the first end of the housing; wherein the first portion fully overlies the first end of the housing; wherein the first portion of the outer wrapper forms a rectangular fold; and wherein the outer wrapper further comprises a heat sealable polymeric layer provided at least on the inner surface of the first portion of the outer wrapper for sealing the heat sealable polymeric layer at the first end of the housing.

According to the invention there is also provided a method of forming a container for consumer goods, the method comprising the steps of providing a housing for consumer goods; an outer wrapper having an inner surface and an outer surface, the outer wrapper comprising a cellulose based layer; wherein at a first end of the housing, the outer wrapper consists of a first portion and a second portion, each of which depends from a respective fold line; wherein the outer wrapper is wrapped around the housing such that the first portion of the outer wrapper fully overlies the second portion of the outer wrapper at the first end of the housing to cover the first end of the housing; wherein the first portion of the outer wrapper forms a rectangular fold; and wherein the outer wrapper further comprises a heat sealable polymeric layer provided at least on the inner surface of the first portion of the outer wrapper for sealing the heat sealable polymeric layer at the first end of the housing.

According to the invention, there is also provided a container for consumer goods, the container comprising: a housing for consumer goods; an outer wrapper having an inner surface and an outer surface, the outer wrapper comprising a cellulose based layer; wherein at a first end of the housing, the outer wrapper consists of a first portion and a second portion, each of which depends from a respective fold line; wherein the outer wrapper is wrapped around the housing such that the first portion of the outer wrapper fully overlies the second portion of the outer wrapper at the first end of the housing to cover the first end of the housing; wherein the first portion of the outer wrapper forms a rectangular fold; and wherein the outer wrapper further comprises a heat sealable polymeric layer provided at least on the inner surface of the first portion of the outer wrapper for sealing the heat sealable polymeric layer at the first end of the housing.

As used herein, the terms "side", "top", "bottom", "front", "back" and other terms used to describe relative positions of the components of containers according to the invention refer to the container in an upright position with the access opening at the top. When describing containers according to the present invention, these terms are used irrespective of the orientation of the container being described. The "bottom" of the container refers to the side of the container opposite the "top" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "wall" refers more generally to a facet of the container, and a wall may be formed from a single panel or flap, or a wall may be formed from two or more abutting or overlapping panels or flaps.

The term "end" is used herein to refer to one of the minor walls of the container or housing. An end may refer to one of the top, bottom, first or second opposed side walls.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines.

The term "hinge line" is used herein to refer to a line about which the lid may be pivoted in order to open the container. A hinge line may be, for example, a fold line or a score line. The hinge line about which the lid is connected to the box may coincide with an edge of the container, or the hinge line may extend across a wall of the container at a position that is spaced apart from the edges.

The term "heat sealable layer" is used herein to refer to a layer capable of fusion bonding by conventional indirect heating means which generates sufficient heat on at least one film contact surface for conduction to a contiguous film contact surface and formation of a bond interface between the surfaces without loss of the film integrity. The bond interface between contiguous layers preferably has sufficient physical strength to withstand the packaging process and subsequent handling. Heat sealable layers may be designed to meet different conditions of expected use and various heat sealable layer formulations are known in the art and may be employed with the present invention.

The term "indicia" is used herein to refer to one or more discrete visual elements, or repeating visual elements or patterns that may provide an aesthetically pleasing or informative representation. The indicia may be in the form of text, images, letters, words, logos, patterns or a combination thereof. By way of example, the indicia may be a brand or manufacturer logo that allows the consumer to identify the type or origin of the consumer goods contained within the container. Additionally, or alternatively, the indicia may comprise an identification code, which may be associated with information regarding production, and can be used to authenticate the consumer goods.

The term "envelope fold" is used herein to describe a sequence of folds which results in the at least partial overlap of two or more panels or flaps of a wrapper to form a wall. A wall formed by an envelope fold thus consists of a wall portion of overlap, wherein two or more of the partially overlapping panels or flaps overlap, and a wall portion of no overlap formed by non-overlapping portions of the partially overlapping panels or flaps.

The term "rectangular fold is used herein to describe a fold which involves folding a rectangular portion of wrapper about a fold line extending along one of the edges of the rectangular portion.

The term "overlie" is used herein to refer to a portion of a wrapper or housing completely covering another portion of the wrapper or housing.

The term "seal" is used herein to refer the act of closing an opening in order to limit the ingress of water or debris.

The method disclosed herein may comprise the steps of providing a housing for consumer goods; providing an outer wrapper, the outer wrapper comprising a cellulose based layer, wherein a heat sealable polymeric layer is provided at least on an inner surface of a first portion of the outer wrapper; folding the outer wrapper around the housing; heating the housing and the outer wrapper to seal the outer wrapper on the housing.

The method according to the invention provides an improved method of forming a container for consumer goods. In contrast with existing containers, the recyclability of a container according to the method of the invention is equal to or better than current packaging solutions. An equal amount or less plastic is used and equal amount or more cellulose based material is used in the realization of the method according to the invention of forming a container when compared with cellulose based containers wrapped with a transparent plastic film.

Additionally, because the cellulose based layer forms the outer surface of the container formed according to the method of the invention, the consumer who is used to plastic film outer wrappers perceives the container as being more eco-friendly. Further, if any indicia are provided on the outer surface of the cellulose based layer, such as registration marks, these can still be easily formed or printed according to standard processes, when compared with plastic film outer wrappers.

Containers according to the method of the invention are easy to manufacture and do not require any substantial modification to existing packing apparatuses. In particular, little to no modification of the folding process for forming the housing using the sheet or the format of the packing machine handling the sheet is required.

Furthermore, the outer wrapper being permanently attached to the housing, there is no waste produced when the user opens the container. On the contrary, in standard known containers, at least a portion of the external plastic film is removed and discarded upon opening of the container.

Additionally, containers formed according to the method of the invention may also provide a user with an improved and simpler unboxing experience. More specifically, as the user does not need to remove and discard any portion of the container, less effort is required to open the container and access the consumer goods housed therein. This may provide a more pleasant experience to the user when compared with conventional containers having a plastic film outer wrapper.

However, in order to adequately seal the outer wrapper made of a cellulose based outer wrapper, a significant amount of heat sealable polymeric material is required. The folding pattern that is typically used to achieve such a seal also impacts the printable space of the outer wrapper as surfaces of the container may have two or more overlapping layers of the outer wrapper, in particular, the layers are merely partially overlapping with each other, instead of one layer being completely covered up by the other top layer. It is possible to print on surfaces with multiple overlapping layers of outer wrapper, but the visual quality of the printing is usually negatively impacted. In particular, printed on such overlapping layers can often lead to interrupted or misaligned prints.

The present inventors have therefore appreciated that in such circumstances, it is advantageous to provide a more simple folding pattern to mitigate the abovementioned drawbacks.

The method disclosed herein may further comprise the steps of folding the outer wrapper around the housing such that a first portion of the outer wrapper overlies a second portion of the outer wrapper at a first end of the housing to cover the first end of the housing, and wherein the first portion forms a rectangular fold.

This novel folding pattern advantageously simplifies the container by reducing the amount of heat sealable polymeric material which is required to seal the outer wrapper, whilst minimising the impact on the visual quality of any manufacturer brand logos, trade marks, slogans and other consumer information or other indicia printed, embossed or debossed on the walls of the container.

Further, because the outermost surface of the outer wrapper at a first end of the housing is formed by the rectangular fold, the printable space available at the first end of the housing for branding, consumer information or indicia is increased. Such a rectangular fold also provides a more simple arrangement and increased space for embossing or debossing branding, consumer information and indicia into the outer wrapper.

The present inventors have also surprisingly found that the configuration described above also provides an improved seal of the outer wrapper which better protects the consumer goods contained in the housing from moisture or the ingress of other external elements which could spoil the consumer goods.

Preferably, one or more edges of the first portion of the outer wrapper are formed by one or more cuts in the outer wrapper. Preferably, the step of providing the outer wrapper comprises making the one or more cuts in the outer wrapper to form the first portion of the outer wrapper. Preferably the first portion of the outer wrapper is connected to the rest of the outer wrapper by a first portion hinge line. Preferably, the outer wrapper is provided with two cuts in the outer wrapper to define a first edge and a second edge of the first portion. Preferably, the two cuts in the outer wrapper are parallel cuts. A blank used to form the outer wrapper according to the method of the invention may therefore have the same dimensions as known blanks used to form outer wrappers. Only the folding pattern may be modified, with the addition of the one or more cuts to form the first portion. This may advantageously mean that containers according to the invention are easy to manufacture and do not require any substantial modification to an existing packing apparatus. Existing blanks for outer wrappers may also be used with minimal modifications required.

The second portion of the outer wrapper may form an envelope fold.

Alternatively, the second portion of the outer wrapper may form a rectangular fold. This arrangement may advantageously provide a container for consumer goods with a first end which is more flush than if the second portion were an envelope fold. In particular, a configuration in which a rectangular fold overlies a rectangular fold has fewer overlapping layers than if a rectangular fold overlies an envelope fold. It is possible to print on surfaces with multiple overlapping layers of outer wrapper, but the visual quality of the printing is usually negatively impacted. In particular, printed on such overlapping layers can often lead to interrupted or misaligned prints. More specifically, the underlying edges or folds may create raised portions which are more difficult to print over.

Preferably, the first portion of the outer wrapper has a shape and size that is the same as the shape and size of the first end of the housing.

By providing an outer wrapper with a first portion having a shape and size that is the same as the shape and size of the first end of the housing, a neater and more simple design is achieved. The space available at the first end of the housing for printing, embossing or debossing otherwise embellishing with manufacturer or branding, consumer information or indicia is maximised. The seal achieved at the first end of the housing may also be improved with this configuration. Additionally, the risk of the outer wrapper being inadvertently removed at the first end of the housing is greatly reduce in such a configuration. In particular, the first portion of the outer wrapper may lie flush against the first end of the housing, with the edges of the first portion of the outer wrapper each coinciding with a corresponding edge of the first end of the housing. The outer wrapper is therefore less likely to get caught, torn or inadvertently removed from the housing.

Preferably, the outer wrapper comprises a metallized layer.

By providing an outer wrapper having a metallized layer, or a metallized outer wrapper, the barrier features of the outer wrapper may be improved. The metallized outer wrapper, may have a significantly reduced permeability to gases or vapours such as oxygen or moisture, thus providing additional protection to the consumer goods housed within the container.

The container for consumer goods formed according to the method of the present invention comprises a housing for consumer goods and an outer wrapper comprising a cellulose based layer. The housing may be formed from a sheet, which is folded to define the structure of the housing. The housing may be understood to be a three-dimensional structure at least partially enclosing a space for holding one or more consumer goods.

The housing and the outer wrapper are heated such that the outer wrapper is sealed onto the housing. Heating the housing and the outer wrapper may comprise heating the housing and the outer wrapper while applying pressure, to seal the outer wrapper on the housing. Preferably, the pressure applied to the outer wrapper is comprised between 1 kiloPascal and 100 kiloPascal. After the application of heat or pressure or both, the outer wrapper may be permanently attached to the housing and it is not possible to remove the outer wrapper without deforming or damaging the container.

Preferably, the outer wrapper is folded such that when it is wrapped around the housing, the outer wrapper fully covers the housing. The outer wrapper may be folded such that it conforms to the shape of the housing. The way in which the outer wrapper is folded depends on the shape of the housing.

Preferably, the outer wrapper is folded around the housing such that a first edge area of the outer wrapper overlaps with an opposed second edge area of the outer wrapper in a longitudinal direction along the housing. It is envisaged that the outer wrapper may also be wrapped around the housing such that a first edge area of the outer wrapper overlaps with an opposed second edge area of the outer wrapper in a transverse direction along the housing.

Preferably, the first portion of the outer wrapper depends from a fold line of a first wall of the outer wrapper. Preferably, the second portion of the outer wrapper depends from a fold line of a second wall of the outer wrapper. Preferably, the second wall of the outer wrapper is opposite to the first wall. Preferably, the first wall of the outer wrapper is a front wall. Preferably, the second wall of the outer wrapper is a back wall.

The first portion of the wrapper may fully overlie the first end of the housing. Where the first portion of the outer wrapper depends from a fold line of a first wall of the outer wrapper, the first portion of the outer wrapper preferably fully overlies the first end of the housing.

At the first end of the housing, the outer wrapper may consist of the first portion of the outer wrapper and the second portion of the outer wrapper. The first portion of the outer wrapper and the second portion of the outer wrapper may each depend from a respective fold line.

Preferably, where at the first end of the housing, the outer wrapper consist of the first portion and the second portion, each depending from a respective fold line, the first portion fully overlies the second portion. Preferably, in such embodiments, the first portion of the outer wrapper fully overlies the first end of the housing.

The exterior surfaces of containers according to the invention may be printed, embossed, debossed or otherwise embellished with manufacturer or brand logos, trade marks, slogans and other consumer information or other indicia.

The container may be configured to house consumer goods such as aerosol-generating articles, one or more aerosol-generating devices, accessories and utilities. The consumer goods may be contained in a single compartment or separate compartments in the container.

The container may be a hinge lid box having a box portion and a lid portion connected to the box portion along a hinge line extending across a back wall of the container, the hinge lid box being formed of the housing and the outer wrapper. The container may have an opening line provided across one or more walls of the container, to separate the lid portion and the box portion. The lid portion can be moved from a first, closed, position in which an opening of the housing is covered to a second, open, position in which the opening of the housing is uncovered. The opening may be defined by the opening line.

The box portion may comprise a box portion front wall, a box portion back wall, first and second opposed box portion side walls and a box portion bottom wall. The box portion may have an opening at a top end of the box portion. The opening of the box portion may be defined by the top edges of the box portion front wall, the box portion back wall and the box portion first and second opposed side walls. The box portion defines an inner space which forms part of a compartment of the container.

The lid portion may comprise a lid portion front wall, a lid portion back wall, first and second lid portion opposed side walls and a lid portion top wall. The lid portion may have an opening at a bottom end of the lid portion. The opening of the lid portion may be defined by the bottom edges of the lid portion front wall, the lid portion back wall and the first and second lid portion side walls. The lid portion may define an inner space which forms part of the compartment of the container.

The opening line may be defined by a line of weakness in one or both of the housing and the outer wrapper. The line of weakness may be a tear tape or an etched line. Where the line of weakness is an etched line, the etched line may have a depth not greater than 80 percent of the thickness of one or both of the housing and the outer wrapper. The container of the invention may therefore be tamper-proof, because in order to open the lid portion, the outer wrapper needs to be broken.

Containers according to the invention find particular application as containers for elongate aerosol-generating articles such as, for example, cigarettes, cigars, cigarillos or other aerosol generators that rely on heating rather than burning tobacco, for example through an electrical heat source or carbon heat source. It will be appreciated that through appropriate choices of the dimensions thereof, containers according to the invention may be designed for different numbers of conventional size, king size, super-king size, slim or super-slim aerosol generating articles. Alternatively, other consumer goods may be housed inside the container. For example, through an appropriate choice of the dimensions, containers according to the invention may be designed to hold a total of between ten and thirty aerosol-generating articles. The aerosol-generating articles may be arranged in different collations, depending on the total number of aerosol-generating articles.

Containers according to the invention may be in the shape of a rectangular parallelepiped, with right-angled longitudinal and right-angled transverse edges. Alternatively, the container may be in the shape of a rectangular parallelepiped with one or more rounded longitudinal edges, rounded transverse edges, bevelled longitudinal edges, or bevelled transverse edges, or combinations thereof.

Typically, the outer dimensions of the container are between about 0.5 mm to about 5 mm larger than the dimensions of the bundle or bundles of aerosol-generating articles housed inside the container.

Preferably, containers according to the invention have a height of between about 60 mm and about 150 mm, more preferably a height of between about 70 mm and about 125 mm, wherein the height is measured from the bottom wall to the top wall of the container. Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container (comprising the hinge between box and lid).

Preferably, the ratio of the height of the container to the depth of the container is in between about 0.3 to 1 and about 10 to 1, more preferably between about 2 to 1 and about 8 to 1, most preferably between about 3 to 1 and 5 to 1.

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Where the container comprises aerosol-generating articles, the container may further comprise waste-compartments, for example for ash or butts, or other consumer goods, for example matches, lighters, extinguishing means, breath-fresheners or electronics. The other consumer goods may be attached to the outside of the container, contained within the container along with the aerosol-generating articles, in a separate compartment of the container or combinations thereof.

The housing may be formed from any suitable materials including, but not limited to, a cellulose based material, plastic, metal, or any combinations thereof. Preferably, the housing is formed from a cellulose based material. Preferably, the housing is formed of a sheet of material. The sheet may be a sheet of cellulose based material. More specifically, the sheet may be a paper sheet or a paperboard sheet, that is, a sheet made of paper of paperboard.

Preferably, the housing comprises a housing front wall, a housing back wall, two opposed housing side walls, a housing bottom wall and a housing top wall. The housing defines an inner surface and an outer surface.

The housing may be formed of two or more sheets of material.

Preferably, the sheet is folded in such a way that the when the housing is closed, it defines a completely closed compartment. The inner compartment defined by the housing is preferably completely separated from the outside. The consumer goods are preferably stored in the compartment of the container.

The sheet forming the housing for consumer goods preferably forms a blank. The blank preferably has the standard shape in the industry, for example, it defines a rectangular sheet of material.

Preferably, the sheet has a basis weight of between 170 grams per square meter and 270 grams per square meter. However, it can be appreciated that sheets with a higher or lower basis weight can be used to form containers according to the invention.

Preferably, the sheet has a thickness of between 170 micrometres and 400 micrometres. However, it can be appreciated that sheets with a higher or lower thickness can be used to form containers according to the invention.

The outer wrapper has a first portion and a second portion. When the outer wrapper is folded around the housing, the first portion of the outer wrapper forms a rectangular fold at a first end of the housing. When the outer wrapper is folded around the housing, the first portion overlies a second portion at the first end of the housing to cover the first end of the housing.

The outer wrapper may be provided with one or more cuts in the outer wrapper to define one or more edges of the first portion. The step of the method of providing the outer wrapper may comprise making the one or more cuts in the outer wrapper to form the first portion. Alternatively, the first portion may be provided with the first portion pre-cut.

The outer wrapper may be provided with two cuts in the outer wrapper to define a first edge and a second edge of the first portion. The two cuts in the outer wrapper may be parallel cuts. Alternatively, the two cuts in the outer wrapper may be non-parallel cuts.

The first portion may be connected to the rest of the outer wrapper by a first portion hinge line. When the outer wrapper is wrapped around the housing, the first portion hinge line may overlie an edge of the housing connecting the front wall with any one of the top, bottom and first or second opposed side walls. Alternatively, when the outer wrapper is wrapped around the housing, the first portion hinge line may overlie an edge of the housing connecting the back wall with any one of the top, bottom and first or second opposed side walls. The first portion hinge line may extend across the entire length of the edge of the housing which it overlies. In other embodiments, the first portion hinge line may extend across only a portion of the edge of the housing which it overlies.

The second portion of the outer wrapper may form an envelope fold.

Alternatively, the second portion of the outer wrapper may form a rectangular fold.

Preferably the first portion of the outer wrapper may have a shape and size that is the same as the shape and size of the first end of the housing. The first portion of the outer wrapper may fully cover the first end of the housing. The first portion of the outer wrapper may lie flush against the first end of the housing, with the edges of the first portion of the outer wrapper each coinciding with a corresponding edge of the first end of the housing. The first portion may also have a shape and size which is different from the shape and size of the first end of the housing. In such a configuration, the first portion may only partially cover the first end of the housing.

Preferably, where the second portion of the outer wrapper forms a rectangular fold, the second portion of the outer wrapper may have a shape and size that is the same as the shape and size of the first end of the housing. The second portion of the outer wrapper may fully cover the first end of the housing. The second portion of the outer wrapper may lie flush against the first end of the housing, with the edges of the second portion of the outer wrapper each coinciding with a corresponding edge of the first end of the housing. The second portion may also have a shape and size which is different from the shape and size of the first end of the housing. In such a configuration, the second portion may only partially cover the first end of the housing.

Preferably, the outer wrapper has a third portion and a fourth portion. When the outer wrapper is folded around the housing, the third portion of the outer wrapper forms a rectangular fold at a second end of the housing. When the outer wrapper is folded around the housing, the third portion overlies a fourth portion at the second end of the housing to cover the second end.

The outer wrapper may be provided with one or more cuts in the outer wrapper to define one or more edges of the third portion. The step of the method of providing the outer wrapper may comprise making the one or more cuts in the outer wrapper to form the third portion. Alternatively, the third portion may be provided with the first portion pre-cut.

The outer wrapper may be provided with two cuts in the outer wrapper to define a first edge and a second edge of the third portion. The two cuts in the outer wrapper may be parallel cuts. Alternatively, the two cuts in the outer wrapper may be non-parallel cuts.

The third portion may be connected to the rest of the outer wrapper by a third portion hinge line. When the outer wrapper is wrapped around the housing, the third portion hinge line may overlie an edge of the housing connecting the front wall with any one of the top, bottom and first or second opposed side walls. Alternatively, when the outer wrapper is wrapped around the housing, the third portion hinge line may overlie an edge of the housing connecting the back wall with any one of the top, bottom and first or second opposed side walls. The third portion hinge line may extend across the entire length of the edge of the housing which it overlies. In other embodiments, the third portion hinge line may extend across only a portion of the edge of the housing which it overlies.

The fourth portion of the outer wrapper may form an envelope fold.

Alternatively, the fourth portion of the outer wrapper may form a rectangular fold.

Preferably the third portion of the outer wrapper may have a shape and size that is the same as the shape and size of the second end of the housing. The third portion of the outer wrapper may fully cover the second end of the housing. The third portion of the outer wrapper may lie flush against the second end of the housing, with the edges of the third portion of the outer wrapper each coinciding with a corresponding edge of the second end of the housing. The third portion may also have a shape and size which is different from the shape and size of the second end of the housing. In such a configuration, the third portion may only partially cover the second end of the housing.

Preferably, where the fourth portion of the outer wrapper forms a rectangular fold, the fourth portion of the outer wrapper may have a shape and size that is the same as the shape and size of the second end of the housing. The fourth portion of the outer wrapper may fully cover the second end of the housing. The fourth portion of the outer wrapper may lie flush against the second end of the housing, with the edges of the fourth portion of the outer wrapper each coinciding with a corresponding edge of the second end of the housing. The fourth portion may also have a shape and size which is different from the shape and size of the second end of the housing. In such a configuration, the fourth portion may only partially cover the second end of the housing.

Preferably, the step of heating the housing and the outer wrapper includes heating the outer wrapper to form a seal at the first end of the container.

A heat sealable polymeric layer is provided at least on an inner surface of a first portion of the outer wrapper. The heat sealable polymeric layer is furthermore preferably optimized for bonding with the cellulose based layer. The characteristics of the heat sealable polymeric layer may be optimised to bond with the sheet of cellulose based material.

Preferably, the step of heating the housing and the outer wrapper includes heating the outer wrapper to form a seal at the second end of the container.

The heat sealable polymeric layer may be on at least 50 percent of the inner surface of the first portion, preferably the heat sealable polymeric layer is on at least 80 percent of the inner surface of the first portion, more preferably, the heat sealable polymeric layer is on the entire inner surface of the first portion.

Preferably, the heat sealable polymeric layer is on an inner surface of a third portion. It will be appreciated that the heat sealable polymeric layer may be provided on an inner surface of other portions of the outer wrapper.

The heat sealable polymeric layer may be on at least 50 percent of the inner surface of the outer wrapper, preferably the heat sealable polymeric layer is on at least 80 percent of the inner surface of the outer wrapper, more preferably, the heat sealable polymeric layer is on the entire inner surface of the outer wrapper.

The outer wrapper may include additional layers, for example additional barrier layers may be added with the purpose of enhancing the barrier performances of the resulting container. For example, a pre-coated cellulose based layer may be used as substrate for the manufacturing of the outer wrapper of the present invention. Pre-coated cellulose based layers for instance may comprise one or more layers of polyvinyl-alcohol (PVOH), polyethylene-co-vinyl-alcohol (EVOH), polyvinylidene di-chloride coatings (PVDC), and styrene-butadiene or styrene-acrylate latexes. These pre-applied coatings (often applied in the paper-mills) may help to achieve a cellulose based layer with excellent surface planarity, hence further enhancing the performances of the coatings described in this invention. Furthermore, pre-applied coatings, such as PVOH, EVOH and PVDC may add additional functionalities such as barrier to odours, aromas and oxygen to the resulting container of the invention. Such pre-applied coatings may often contain mineral fillers such as calcium carbonate, kaolin, talcum, mica or other platelet type minerals.

The heat sealable polymeric layer may be a first heat sealable polymeric layer. The method of forming a container according to the invention may comprise providing a second polymeric layer on the outer wrapper. The second polymeric layer may be provided between the cellulose based layer and the first heat sealable polymeric layer. The second polymeric layer may be alternatively be provided on the outer surface of the cellulose based layer. The second polymeric layer may be a moisture barrier. The moisture barrier may provide additional protection to the consumer goods housed in the container as it may provide a better barrier between the outside of the container and the inside of the container. The second polymeric layer may comprise fillers such as calcium carbonate, kaolin, talcum, mica or other platelet type minerals. Preferably the second polymeric layer is not sealable and may be crosslinked or comprise crosslinking agents.

The second polymeric layer may be on at least 50 percent of the inner surface of the outer wrapper, preferably the second polymeric layer is on at least 80 percent of the inner surface of the outer wrapper, more preferably, the second polymeric layer extends across the entire inner surface of the outer wrapper. It is desirable to have a large coverage area of the second polymeric layer as the greater the coverage of the second polymeric layer, the greater the seal achieved between the inside of the container and the outside of the outer wrapper.

Preferably, one or both of the first or second polymeric layer comprises a composition comprising one or more of a polymer or copolymer of ethylene, a polymer or copolymer of propylene, a copolymer of styrene acrylate, a copolymer of styrene butadiene, a copolymer of styrene isoprene, a copolymer of hydrogenated styrene butadiene, a copolymer of hydrogenated styrene isoprene, a copolymer of an ester of acrylic or methacrylic acid, a copolymer of vinyl acetate.

Preferably, the composition comprises a polymer, copolymer or omopolymer of ethylene and one of propylene, 1-butene, isobutylene, 1-octene, 1-exene, norbornene, vinyl acetate, acrylic or metacryllic esters, acrylic or metacryllic acids, dicyclopentadiene.

Preferably, the composition comprises a polymer, copolymer or omopolymer of propylene and one of ethylene, 1-butene, isobutylene, 1-octene, 1-exene, norbornene, vinyl acetate, acrylic or methacrylic esters, acrylic or methacrylic acids, dicyclopentadiene.

Preferably, the composition further comprises wax. The wax may comprise one or more of paraffin wax, polyethylene wax, microcrystalline wax, polypropylene wax. The composition may have any percentage content of wax. Preferably, the content of wax may be comprised between 10 percent and 40 percent by weight of the composition.

Preferably, the composition further comprises hydrocarbon resin. The hydrocarbon resin may comprise one or more of hydrogenated hydrocarbon resin, polyterpene resin. The composition may have any percentage content of hydrocarbon resin. Preferably the content of hydrocarbon resin is comprised between 30 percent and 50 percent by weight of the composition.

Preferably, the content of polymer or copolymer is comprised between 30 percent and 50 percent by weight of the composition.

Preferably, the first heat sealable polymeric layer has a basis weight of between 4 grams per square meter and 10 grams per square meter.

Preferably the second polymeric layer has a basis weight of between 5 grams per square meter and 10 grams per square meter.

Preferably, the first heat sealable polymeric layer has a melting point measured according to differential scanning calorimetry (DSC) lower than 120 degrees Celsius.

Preferably, the second polymeric layer does not show a thermoplastic behaviour at the temperature and pressure used to melt the first heat sealable polymeric layer. This may ensure that the second polymeric layer is not affected by the heating of the first heat sealable polymeric layer. Thus when the first heat sealable polymeric layer is heated to seal the outer wrapper onto the housing, the second polymeric layer remains intact.

Preferably, the second polymeric layer has a melting point measured according to differential scanning calorimetry (DSC) higher than the melting temperature of the first heat sealable polymeric layer.

Preferably, the outer wrapper comprises a metallized layer. For example, a pre-coated cellulose based layer may be a metallized paper. For the purpose of this invention. A cellulose based layer may be metallized before the application of one or more polymeric layers. The metallized layer may be a barrier layer with the purpose of enhancing the barrier performances of the resulting container. By providing an outer wrapper having a metallized layer, or a metallized outer wrapper, the barrier features of the outer wrapper may be improved. The metallized outer wrapper, may have a significantly reduced permeability to gases or vapours such as oxygen or moisture, thus providing additional protection to the consumer goods housed within the container. The metallized later may also be used for decorative purposes.

Preferably, the step of providing the outer wrapper comprises applying the metallized layer to the cellulose based layer.

The metallized layer may be on an inner surface of the cellulose based layer. Alternatively, the metallized layer may be on an outer surface of the cellulose based layer. Where the metallized layer is on an outer surface of the of the cellulose based layer, the metallized layer may impart a more appealing visual appearance to the outer wrapper.

Preferably, the metallized layer is an aluminium layer. However, the metallized layer may be a layer comprising any suitable metal.

Preferably, the metallized layer is between the cellulose based layer and the heat sealable polymeric layer.

The heat sealable polymeric layer may be on at least 50 percent of the inner surface of the metallized layer, preferably the heat sealable polymeric layer is on at least 80 percent of the inner surface of the metallized layer, more preferably, the heat sealable polymeric layer is on the entire inner surface of the metallized layer.

The metallized layer may have a thickness of at least 10 nanometres, preferably, the metallized layer has a thickness of at least 15 nanometres.

A primer layer may be between the cellulose based layer and the metallized layer. The primer layer may smoothen the surface of the cellulose based layer and provide a suitable anchoring layer for the deposition of the metallized layer.

A protective layer may cover the metallized layer. The protective layer may protect the metallized layer from damage that may occur during handling and forming of the container. The protective layer can be manufactured by applying solutions or dispersions of appropriate polyester resins such as polycondensates of terephatalic acid, isophthalic acid, adipic acid, azelaic acid, and one or more diols such as ethylene glycol, 1,3-propanediol, 1,4 propane diol, diethylene glycol, neopentyl glycol, 2-methyl-1,3-propanediol. The protective layer may also be manufactured from a mixture from at least two diacids or their methyl esters monomers and at least one or more glycols enable to have polymers with good solubility and adhesion toward the metallic layer. Other suitable compositions suitable for the manufacture of top coatings comprise solutions of polymers such as cellulose acetate or propionate, dispersions of copolymers of various olefins such as ethylene and acrylic or methacrylic acid, solutions or dispersions of hydrogenated hydrocarbon resins.

Preferably, the cellulose based layer has a basis weight of between 40 grams per square meter and 70 grams per square meter.

Preferably, the lid portion is connected to the box portion by a hinge line. The hinge line may allow the lid to be moved between the closed position and the open position. In the closed position, the lid portion may cover the opening of the box portion. In the open position, the opening of the box portion may not be covered by the lid portion.

The hinge line may be formed in the back wall of the housing and the back wall of the overlying outer wrapper.

The hinge line may extend across only a portion of the box portion back wall. Alternatively, the hinge line may extend across the full length of the box portion back wall.

Features described in relation to one example or embodiment may also be applicable to other examples and embodiments.

Below, there is provided a non-exhaustive list of non-limiting examples. Any one or more of the features of these examples may be combined with any one or more features of another example, embodiment, or aspect described herein.

EX 1. A method of forming a container for consumer goods, the method comprising the steps of: providing a housing for consumer goods; providing an outer wrapper, the outer wrapper comprising a cellulose based layer, wherein a heat sealable polymeric layer is provided at least on an inner surface of a first portion of the outer wrapper; folding the outer wrapper around the housing such that a first portion of the outer wrapper overlies a second portion of the outer wrapper forms at a first end of the housing to cover the first end of the housing, wherein the first portion forms a rectangular fold; and heating the housing and the outer wrapper to seal the outer wrapper on the housing.

EX 2. A method according to EX1, wherein heating the housing and the outer wrapper comprises heating the housing the outer wrapper while applying pressure, to seal the outer wrapper on the housing.

EX 3. A method according to EX 1 or EX 2, wherein the outer wrapper is provided with one or more cuts in the outer wrapper to define one or more edges of the first portion.

EX 4. A method according to EX 3, wherein the step of providing an outer wrapper comprises making the one or more cuts in the outer wrapper to form the first portion.

EX 5. A method according to EX 3 or EX 4, wherein the first portion is connected to the rest of the outer wrapper by a first portion hinge line.

EX 6. A method according to any one of EX 3 to 5, wherein the outer wrapper is provided with two cuts in the outer wrapper to define a first edge and a second edge of the first portion.

EX 7. A method according to EX 6, wherein the two cuts in the outer wrapper are parallel cuts.

EX 8. A method according to any preceding EX, wherein the second portion of the outer wrapper forms an envelope fold.

EX 9. A method according to any one of EX 1 to EX7, wherein the second portion of the outer wrapper forms a rectangular fold.

EX 10. A method according to any preceding EX, wherein the housing is formed from a sheet of cellulose based material.

EX 11. A method according to any preceding EX, wherein the first portion of the outer wrapper has a shape and size that is the same as the shape and size of the first end of the housing.

EX 12. A method according to any preceding EX, wherein the heat sealable polymeric layer is on at least 50 percent of the inner surface of the first portion, preferably the heat sealable polymeric layer is on at least 80 percent of the inner surface of the first portion, more preferably, the heat sealable polymeric layer is on the entire inner surface of the first portion.

EX 13. A method according to any preceding EX, wherein the outer wrapper comprises a metallized layer.

EX 14. A method according to EX 13, wherein the step of providing the outer wrapper comprises applying the metallized layer to the cellulose based layer.

EX 15. A method according to EX 14, wherein the metallized layer is on an inner surface of the cellulose based layer.

EX 16. A method according to EX 14, wherein the metallized layer is on an outer surface of the cellulose based layer.

EX 17. A method according to any one of EX 13 or EX 16, wherein the metallized layer is an aluminium layer.

EX 18. A method according to EX 15, wherein the metallized layer is between the cellulose based layer and the heat sealable polymeric layer.

EX 19. A method according to any one of EX 13 to 18, wherein the metallized layer has a thickness of at least 10 nanometres, preferably the metallized layer has a thickness of at least 15 nanometres.

EX 20. A method according to any one of EX 15 to 19, wherein a primer layer is between the cellulose based layer and the metallized layer.

EX 21. A method according to any one of EX 13 to 20, wherein a protective layer covers the metallized layer.

EX 22. A method according to any preceding EX, wherein the step of folding the outer wrapper around the housing comprises wrapping the outer wrapper around the housing such that the outer wrapper fully covers the housing.

EX 23. A method according to any preceding EX, wherein the step of folding the outer wrapper around the housing comprises wrapping the outer wrapper around the housing such that a first edge area of the outer wrapper overlaps with an opposed second edge area of the outer wrapper in a longitudinal direction along the housing.

EX 24. A method according to any preceding EX, wherein the step of folding the outer wrapper around the housing comprises wrapping the outer wrapper around the housing such that a third portion of the outer wrapper overlies a fourth portion at a second end of the housing to cover the second end of the housing; and wherein the third portion of the outer wrapper forms a rectangular fold.

EX 25. A method according to EX 24, wherein the fourth portion of the outer wrapper forms an envelope fold.

EX 26. A method according to EX 24, wherein the fourth portion of the outer wrapper forms a rectangular fold.

EX 27. A method according to any one of EX 24 to EX 26, wherein the heat sealable polymeric layer is on an inner surface of the third portion.

EX 28. A method according to any preceding EX, wherein the heat sealable polymeric layer is on at least 50 percent of the inner surface of the outer wrapper, preferably the heat sealable polymeric layer is on at least 80 percent of the inner surface of the outer wrapper, more preferably, the heat sealable polymeric layer is on the entire inner surface of the outer wrapper.

EX 29. A method according to any preceding EX, wherein the step of heating the housing and the outer wrapper includes heating the outer wrapper to form a seal at the first end of the container.

EX 30. A method according to any one of EX 24 to 29, wherein the step of heating the housing and the outer wrapper includes heating the outer wrapper to form a seal at the second end of the container.

EX 31. A method according to any preceding EX, wherein the housing is generally parallelepiped shaped.

EX 32. A method according to any preceding EX, wherein the container is a hinge lid box comprising a box portion and a lid portion connected to the box portion along a hinge line extending across a back wall of the container, the hinge lid box being formed by the housing and the outer wrapper.

EX 33. A method according to EX 32, wherein the lid portion can be moved from a first, closed, position in which an opening of the housing is covered to a second, open, position in which the opening of the housing is uncovered.

EX 34. A method according to EX 32 or EX 33, wherein an opening line is provided extending across one or more walls of the container, to separate the lid portion and the box portion.

EX 35. A method according to EX 34, wherein the opening line is defined by a line of weakness in one or both of the housing and the outer wrapper.

EX 36. A method according to EX 35, wherein the line of weakness in one or both of the housing and the outer wrapper is a tear tape or an etched line.

EX 37. A method according to EX 36, wherein the line of weakness in one or both of the housing and the outer wrapper includes an etched line having a depth not greater than 80 percent of the thickness of one or both of the housing and the outer wrapper.

EX 38. A method according to any preceding EX, wherein the heat sealable polymeric layer is a first heat sealable polymeric layer; and comprising the step of providing a second polymeric layer on the outer wrapper.

EX 39. A method according to EX 38, comprising the step of providing the second polymeric layer between the cellulose based layer and the first heat sealable polymeric layer.

EX 40. A method according to EX 38 or EX 39, wherein the second polymeric layer is a moisture barrier.

EX 41. A method according to any one of EX 38 to 40, wherein the second polymeric layer extends across the entire inner surface of the outer wrapper.

EX 42. A method according to any one of EX 38 to 40, wherein one or both of the first or second polymeric layer comprises a composition comprising one or more of a polymer or copolymer of ethylene, a polymer or copolymer of propylene, a copolymer of styrene acrylate, a copolymer of styrene butadiene, a copolymer of styrene isoprene, an hydrogenated copolymer of styrene and butadiene, an hydrogenated copolymer of styrene and isoprene, a copolymer of styrene and isobutylene, a copolymer of an ester of acrylic or methacrylic acid, a copolymer of vinyl acetate.

EX 43. A method according to EX 42, wherein the composition comprises a polymer, copolymer or omopolymer of ethylene and one of propylene, 1-butene, isobutylene, 1-octene, 1-exene, norbornene, vinyl acetate, acrylic or metacryllic esters, acrylic or metacryllic acids, dicyclopentadiene.

EX 44. A method according to EX 42, wherein the composition comprises a polymer, copolymer or omopolymer of propylene and one of ethylene, 1-butene, isobutylene, 1-octene, 1-exene, norbornene, vinyl acetate, acrylic or methacrylic esters, acrylic or methacrylic acids, dicyclopentadiene.

EX 45. A method according to any one of EX 42 to 44, wherein the composition further comprises wax.

EX 46. A method according to EX 45, wherein the wax comprises one or more of paraffin wax, polyethylene wax, microcrystalline wax, polypropylene wax.

EX 47. A method according to any one of EX 42 to 46, wherein the composition further comprises hydrocarbon resin.

EX 48. A method according to EX 47, wherein the hydrocarbon resin comprises one or more of hydrogenated hydrocarbon resin, polyterpene resin.

EX 49. A method according to any one of claims 12, 15, 22, and 23, wherein the content of wax is comprised between 10 percent and 40 percent by weight of the composition.

EX 50. A method according to any one of EX 47 to 49, wherein the content of hydrocarbon resin is comprised between 30 percent and 50 percent by weight of the composition.

EX 51. A method according to any one of EX 42 to 50, wherein the content of polymer or copolymer is comprised between 30 percent and 50 percent by weight of the composition.

EX 52. A method according to any preceding EX, wherein the sheet has a basis weight of between 170 grams per square meter and 270 grams per square meter.

EX 53. A method according to any preceding EX, wherein the cellulose based layer has a basis weight of between 40 grams per square meter and 70 grams per square meter.

EX 54. A method according to any preceding EX, wherein the first heat sealable polymeric layer has a basis weight of between 4 grams per square meter and 15 grams per square meter.

EX 55. A method according to any one of EX 38 to 54, wherein the basis weight of the second polymeric layer is between 5 grams per square meter and 10 grams per square meter.

EX 56. A method according to any preceding EX, wherein the sheet has a thickness of between 170 micrometres and 400 micrometres.

EX 57. A method according to any preceding EX, wherein the cellulose based layer has a thickness of between 30 micrometres and 70 micrometres.

EX 58. A method according to any preceding EX, wherein the first heat sealable polymeric layer has a melting point measured according to differential scanning calorimetry (DSC) lower than 120 degrees Celsius.

EX 59. A method according to any one of EX 38 to 58, wherein the second polymeric layer does not show a thermoplastic behaviour at the temperature and pressure used to melt the first heat sealable polymeric layer.

EX 60. A method according to EX 59, wherein the second polymeric layer has a melting point measured according to differential scanning calorimetry (DSC) higher than the melting temperature of the first heat sealable polymeric layer.

EX 61. A container for consumer goods, the container comprising: a housing for consumer goods; an outer wrapper having an inner surface and an outer surface, the outer wrapper comprising a cellulose based layer; wherein the outer wrapper is wrapped around the housing such that a first portion of the outer wrapper overlies a second portion of the outer wrapper at a first end of the housing, the first portion overlying the second portion to cover the first end of the housing; wherein the first portion forms a rectangular fold; and wherein the outer wrapper further comprises a heat sealable polymeric layer provided at least on the inner surface of the first portion of the outer wrapper for sealing the outer wrapper at the first end of the housing.

EX 62. A container for consumer goods according to EX 61, wherein one or more edges of the first portion of the outer wrapper are formed by one or more cuts in the outer wrapper.

EX 63. A container for consumer goods according to EX 62, wherein the first portion is connected to the rest of the outer wrapper by a first portion hinge line.

EX 64. A container for consumer goods according to EX 62 or EX 63, wherein the first portion of the outer wrapper is formed by two cuts in the outer wrapper.

EX 65. A container for consumer goods according to EX 64, wherein the two cuts in the outer wrapper are parallel cuts.

EX 66. A container for consumer goods according to any one of EX 61 to 65, wherein the second portion of the outer wrapper forms an envelope fold.

EX 67. A container for consumer goods according to any one of EX 61 to 65, wherein the second portion of the outer wrapper forms a rectangular fold.

EX 68. A container for consumer goods according to any one of EX 61 to 67, wherein the housing is formed from a cellulose based material EX 69. A container for consumer goods according to any one of EX 61 to 68, wherein the first portion of the outer wrapper has a shape and size that is the same as the shape and size of the first end of the housing.

EX 70. A container for consumer goods according to any one of EX 61 to 69, wherein the heat sealable polymeric layer is on at least 30 percent of the inner surface of the first portion, preferably the heat sealable polymeric layer is on at least 80 percent of the inner surface of the first portion, more preferably, the heat sealable polymeric layer is on the entire inner surface of the first portion.

EX 71. A container for consumer goods according to any one of EX 61 to 70, wherein the outer wrapper further comprises a metallized layer.

EX 72. A container for consumer goods according to EX 71, wherein the metallized layer is on an inner surface of the cellulose based layer.

EX 73. A container for consumer goods according to EX 71, wherein the metallized layer is on an outer surface of the cellulose based layer.

EX 74. A container for consumer goods according to any one of EX 71 to 73, wherein the metallized layer is an aluminium layer.

EX 75. A container for consumer goods according to EX 72, wherein the metallized layer is between the cellulose based layer and the heat sealable polymeric layer.

EX 76. A container for consumer goods according to any one of EX 71 to 73, wherein the metallized layer has a thickness of at least 10 nanometres, preferably the metallized layer has a thickness of at least 15 nanometres.

EX 77. A container for consumer goods according to any one of EX 72 to 76, wherein a primer layer is between the cellulose based layer and the metallized layer.

EX 78. A container for consumer goods according to any one of EX 71 to 77, wherein a protective layer covers the metallized layer.

EX 79. A container for consumer goods according to any one of EX, 61 to 78 wherein the outer wrapper fully covers the housing.

EX 80. A container for consumer goods according to any one of EX 61 to 79, wherein the outer wrapper is wrapped around the housing such that a first edge area of the outer wrapper overlaps with an opposed a second edge area of the outer wrapper in a longitudinal direction along the housing.

EX 81. A container for consumer goods according to any one of EX 61 to 80, wherein the outer wrapper is wrapped around the housing such that a third portion of the outer wrapper overlies a fourth portion at a second end of the housing to cover the second end of the housing; and wherein the third portion of the outer wrapper forms a rectangular fold.

EX 82. A container for consumer goods according to EX 81, wherein the fourth portion of the outer wrapper forms an envelope fold.

EX 83. A container for consumer goods according to EX 81, wherein the fourth portion of the outer wrapper forms a rectangular fold.

EX 84. A container for consumer goods according to any one of EX 81 to 83, wherein the heat sealable polymeric layer is provided on an inner surface of the third portion.

EX 85. A container for consumer goods according to any one of EX 61 to 84, wherein the heat sealable polymeric layer is on at least 50 percent of the inner surface of the outer wrapper, preferably the heat sealable polymeric layer is on at least 80 percent of the inner surface of the outer wrapper, more preferably, the heat sealable polymeric layer is on the entire inner surface of the outer wrapper.

EX 86. A container for consumer goods according to any one of EX 61 to 85, wherein the outer wrapper forms a seal at the first end of the container.

EX 87. A container for consumer goods according to any one of EX 81 to 86, wherein the outer wrapper forms a seal at the second end of the container.

EX 88. A container for consumer goods according to any one of EX 61 to 87, wherein the housing is generally parallelepiped shaped.

EX 89. A container for consumer goods according to any one of EX 61 to 88, wherein the container is a hinge lid box comprising a box portion and a lid portion connected to the box portion along a hinge line extending across a back wall of the container, the hinge lid box being formed by the housing and the outer wrapper.

EX 90. A container for consumer goods according to EX 89, wherein the lid portion can be moved from a first, closed, position in which an opening of the housing is covered to a second, open, position in which the opening of the housing is uncovered.

EX 91. A container for consumer goods according to EX 89 or EX 90, wherein the lid portion and the box portion are separated by an opening line extending across one or more walls of the container.

EX 92. A container for consumer goods according to EX 91, wherein the opening line is defined by a line of weakness in one or both of the housing and the outer wrapper.

EX 93. A container for consumer goods according to EX 92, wherein the line of weakness in one or both of the housing and the outer wrapper is a tear tape or an etched line.

EX 94. A container for consumer goods according to EX 93, wherein the line of weakness in one or both of the housing and the outer wrapper includes an etched line having a depth not greater than 80 percent of the thickness of the one or both of the housing and the outer wrapper.

EX 95. A container for consumer goods according to any one of EX 94 to 90 wherein the heat sealable polymeric layer is a first heat sealable polymeric layer and the outer wrapper further comprises a second polymeric layer.

EX 96. A container for consumer goods according to EX 95, wherein the second polymeric layer is provided between the cellulose based layer and the first heat sealable polymeric layer.

EX 97. A container for consumer goods according to EX 95 or EX 96, wherein the second polymeric layer is a moisture barrier.

EX 98. A container for consumer goods according to any one of EX 95 to 97, wherein the second polymeric layer extends across the entire inner surface of the outer wrapper.

EX 99. A container for consumer goods according to any one of EX 61 to 98, wherein one or both of the first or second polymeric layer comprises a composition comprising one or more of a polymer or copolymer of ethylene, a polymer or copolymer of propylene, a copolymer of styrene acrylate, a copolymer of styrene butadiene, a copolymer of styrene isoprene, a copolymer of hydrogenated styrene butadiene, a copolymer of hydrogenated styrene isoprene, a copolymer of an ester of acrylic or methacrylic acid, a copolymer of vinyl acetate.

EX 100. A container for consumer goods according to EX 99, wherein the composition comprises a polymer, copolymer or omopolymer of ethylene and one of propylene, 1-butene, isobutylene, 1-octene, 1-exene, norbornene, vinyl acetate, acrylic or metacryllic esters, acrylic or metacryllic acids, dicyclopentadiene.

EX 101. A container for consumer goods according to EX 100, wherein the composition comprises a polymer, copolymer or omopolymer of propylene and one of ethylene, 1-butene, isobutylene, 1-octene, 1-exene, norbornene, vinyl acetate, acrylic or methacrylic esters, acrylic or methacrylic acids, dicyclopentadiene.

EX 102. A container for consumer goods according to any one of EX 99 to 101, wherein the composition further comprises wax.

EX 103. A container for consumer goods according to EX 102, wherein the wax comprises one or more of paraffin wax, polyethylene wax, microcrystalline wax, polypropylene wax.

EX 104. A container for consumer goods according to any one of EX 99 to 103, wherein the composition further comprises hydrocarbon resin.

EX 105. A container for consumer goods according to EX 104, wherein the hydrocarbon resin comprises one or more of hydrogenated hydrocarbon resin, polyterpene resin.

EX 106. A container for consumer goods according to any one of EX 105 to 101, wherein the content of wax is comprised between 10 percent and 40 percent by weight of the composition.

EX 107. A container for consumer goods according to any one of EX 104 to 106, wherein the content of hydrocarbon resin is comprised between 30 percent and 50 percent by weight of the composition.

EX 108. A container for consumer goods according to any one of EX 99 to 107, wherein the content of polymer or copolymer is comprised between 30 percent and 50 percent by weight of the composition.

EX 109. A container for consumer goods according to any one of EX 61 to 108 wherein the sheet has a basis weight of between 170 grams per square meter and 270 grams per square meter.

EX 110. A container for consumer goods according to any one of EX 61 to 109, wherein the cellulose based layer has a basis weight of between 40 grams per square meter and 70 grams per square meter.

EX 111. A container for consumer goods according to any one of EX 61 to 110, wherein the polymeric layer has a basis weight of between 4 grams per square meter and 15 grams per square meter.

EX 112. A container for consumer goods according to any one of EX 95 to 111, wherein the basis weight of the second polymeric layer is between 5 grams per square meter and 10 grams per square meter.

EX 113. A container for consumer goods according to any one of EX 61 to 112, wherein the sheet has a thickness of between 170 micrometres and 400 micrometres.

EX 114. A container for consumer goods according to any one of EX 61 to 113, wherein the cellulose based layer has a thickness of between 30 micrometres and 60 micrometres.

EX 115. A container for consumer goods according to any one of EX 61 to 114, wherein the polymeric layer has a melting point measured according to differential scanning calorimetry (DSC) lower than 120 degrees Celsius.

EX 116. A container for consumer goods according to any one of EX 95 to 115, wherein the second polymeric layer does not show a thermoplastic behaviour at the temperature and pressure used to melt the first heat sealable polymeric layer.

EX 117. A container for consumer goods according to EX 116, wherein the second polymeric layer has a melting point measured according to differential scanning calorimetry (DSC) higher than the melting temperature of the first heat sealable polymeric layer.

EX 118. A container for consumer goods according to any of EX 61 to EX 117, wherein the first portion of the outer wrapper depends from a fold line of a first wall of the outer wrapper.

EX 119. A container for consumer goods according to EX 118, wherein the second portion of the outer wrapper depends from a fold line of a second wall of the outer wrapper.

EX 120. A container for consumer goods according to EX 119, wherein the second wall of the outer wrapper is opposite to the first wall.

EX 121. A container for consumer goods according to any of EX 118 to EX 120, wherein the first wall of the outer wrapper is a front wall.

EX 122. A container for consumer goods according to any of EX 119 to EX 121, wherein the second wall of the outer wrapper is a back wall.

EX 123. A container for consumer goods according to any of EX 61 to EX 122, wherein the first portion of the wrapper fully overlies the first end of the housing.

EX 124. A container for consumer goods according to any of EX 61 to EX 123, wherein at the first end of the housing, the outer wrapper consists of the first portion of the outer wrapper and the second portion of the outer wrapper.

EX 125. A container for consumer goods according to any of EX 61 to EX 124, wherein the first portion of the outer wrapper preferably fully overlies the second portion of the outer wrapper.

Embodiments of the invention will now be described in detail, by way of example only, with reference to the accompanying drawings, in which.

Figure 1:
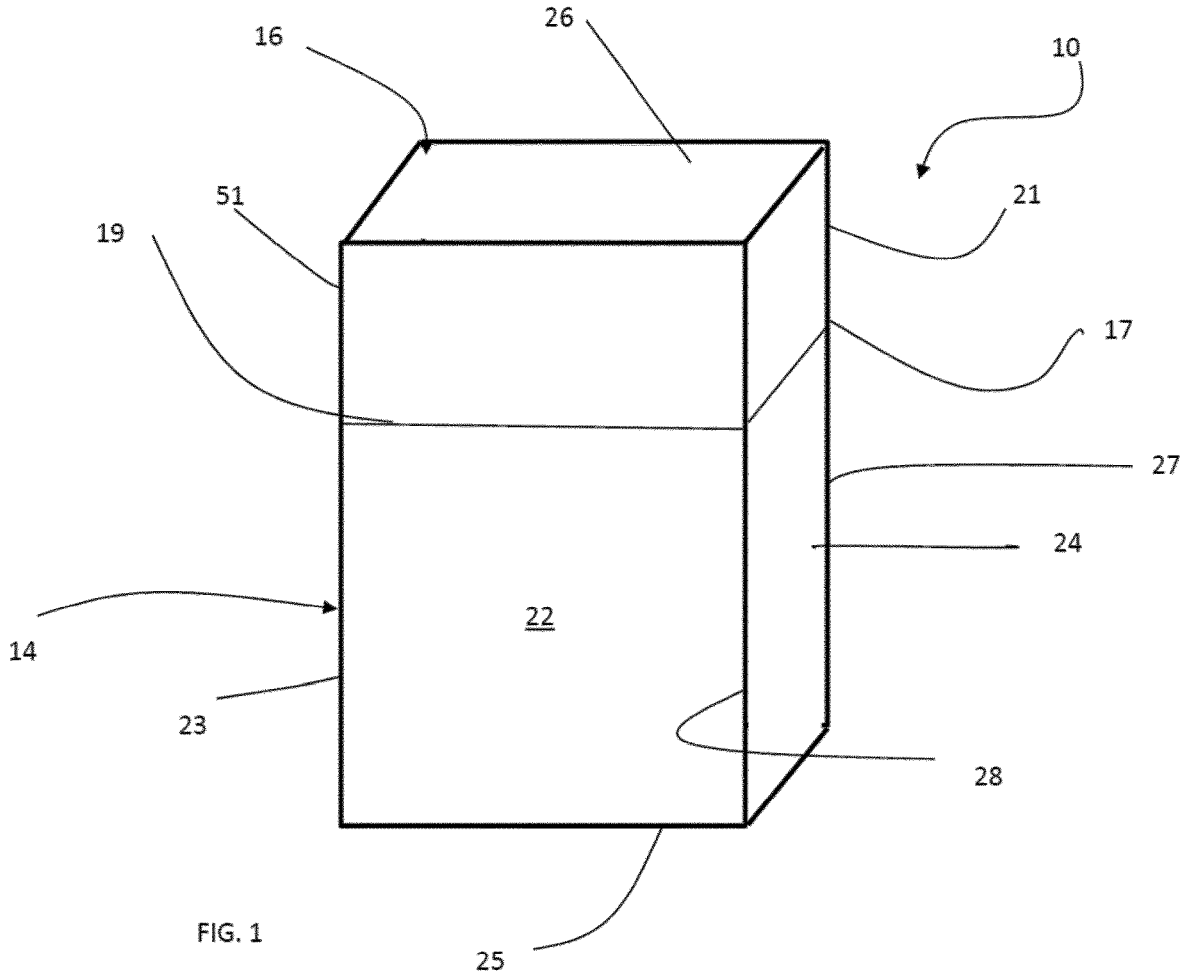
FIG. 1 shows a perspective schematic view of a container according to the invention.

FIG. 1 shows a housing 10 to be used in a container formed in accordance with the method of the present invention. The housing 10 has the shape of a rectangular parallelepiped and includes a box portion 14 and a lid portion 16. The parallelepiped defines a back wall 21, a front wall 22, a left side wall 23, a right side wall 24, a bottom wall 25 and a top wall 26.

The housing further comprises a first right edge 27 and a second right edge 28 of the housing 10. First right edge 27 is formed between the back wall 21 and the right side wall 24, while second right edge 28 is formed between the front wall 22 and the right side wall 24. The housing 10 also comprises a first left edge 29 formed between the back wall 21 and the left side wall 23, and a second left edge 51 formed between the front wall 22 and the left side wall 23 (edge 29 is visible in FIG. 14).

The lid portion 16 is hinged about a hinge line 17 extending across a back wall of the housing. Further, the housing 10 defines a housing or inner volume (not depicted in the drawings) containing for example a group of aerosol generating articles (not shown in the drawings). When the housing 10 is closed, the lid portion 16 and the box portion 14 define an opening line 19 which is the separation line between the lid portion and box portion. The opening line 19 is the geometrical continuation of the hinge line 17. The opening line 19 is formed on the left side wall 23, right side wall 24 and on the front wall 22.

The opening line 19 is a line of weakness, such as a cut line, so that the housing 10 can be opened immediately, or it may be etched, and therefore the housing 10 cannot be opened, unless the opening line is broken 19.

Figure 2:
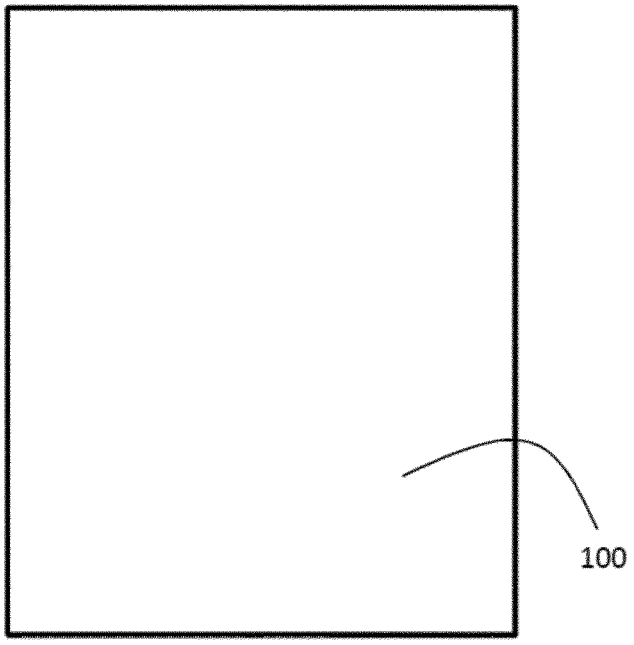
FIG. 2 shows a front view of a sheet forming the housing of the container of FIG. 1.
Figure 3:
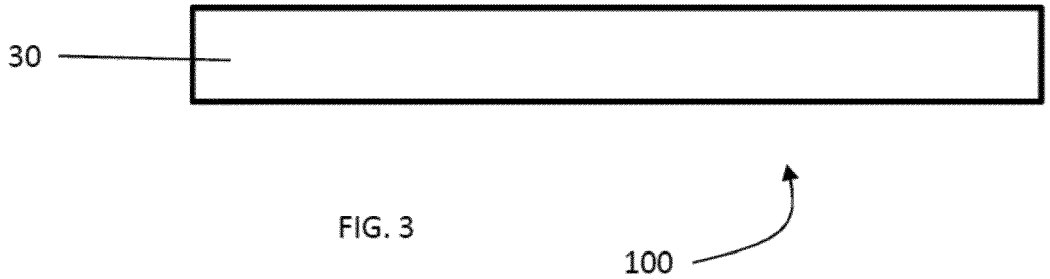
FIG. 3 shows an enlarged side view of the sheet of FIG. 2.

The housing 10 is formed from a sheet 100 depicted in FIGS. 2 and 3. As illustrated in the side view of FIG. 3, the sheet 100 comprises a cellulose based material 30. More preferably, the sheet comprises a sheet of cellulose based material 30. In more detail, the sheet of cellulose based material 30 is formed from a sheet of a paper-based material. Preferably, the sheet of cellulose based material 30 has a basis weight between 170 gsm and 270 gsm. Preferably, the sheet of cellulose based material has a thickness between 170 micrometers and 400 micrometers.

The sheet 100 is folded as known in the field to form the housing 10. Any geometrical shape of the housing is possible.

The housing 10 formed by suitably folding the sheet 100 is then wrapped using an outer wrapper in order to form a container 1 (shown in FIG. 17) to contain consumer goods (not shown), for example for containing aerosol generating articles.

Figure 4:
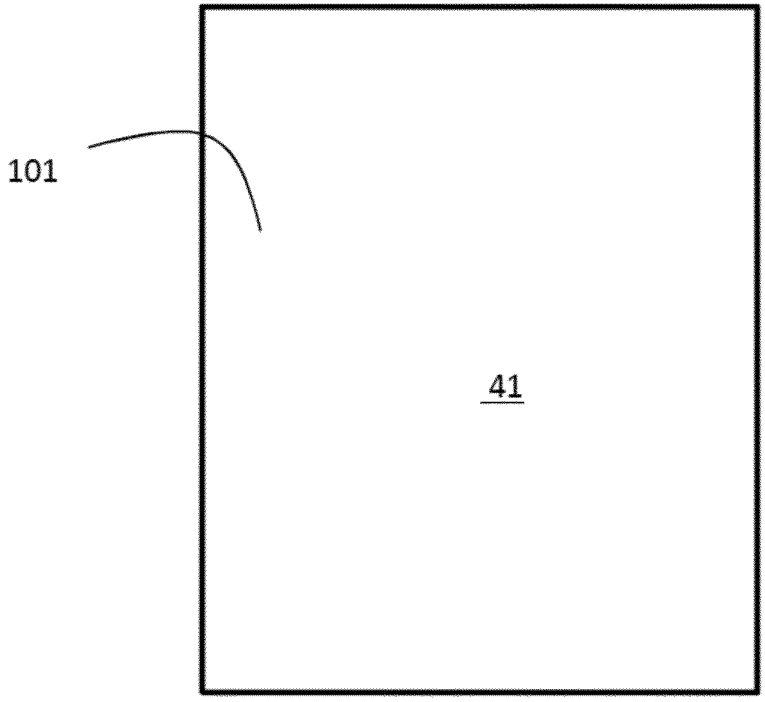
FIG. 4 shows a front view of an outer wrapper of a container according to the invention.
Figure 5:
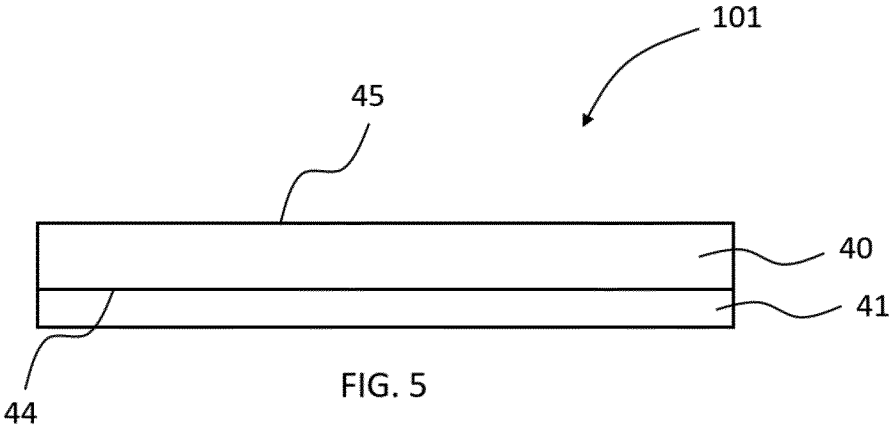
FIG. 5 shows an enlarged side view of the outer wrapper of FIG. 4 according to a first embodiment.

The outer wrapper is formed from a blank 101 depicted in FIGS. 4 to 9. In a first embodiment illustrated in FIG. 5, the blank 101 comprises a cellulose based layer 40 comprising a cellulosic material and a heat sealable polymeric layer 41 having heat sealing properties. The cellulose based layer 40 has an inner surface 44 and an outer surface 45. The heat sealable polymeric layer 41 covers the inner surface 44 of the cellulose based layer 40 completely, as depicted in FIG. 4.

Figure 6:
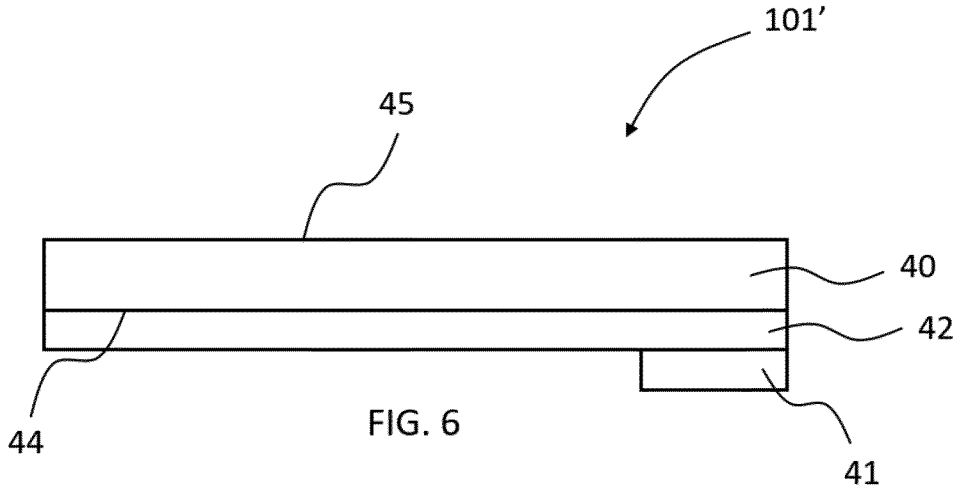
FIG. 6 shows an enlarged side view of the outer wrapper of FIG. 4 according to a second embodiment.

In a second embodiment illustrated in FIG. 6, the blank 101' comprises a cellulose based layer 40 comprising a cellulosic material and a heat sealable polymeric layer 41 having heat sealing properties. The cellulose based layer 40 has an inner surface 44 and an outer surface 45. The heat sealable polymeric layer 41 only partially covers the inner surface 44 of the cellulose based layer 40.

In more detail, the cellulose based layer 40 is formed from a sheet of a paper-based material. Preferably, the heat sealable polymeric layer 41 has a basis weight between 4 gsm and 15 gsm.

In the embodiment depicted in FIG. 6, the blank 101' forming the outer wrapper comprises a second polymeric layer 42. The second polymeric layer 42 is a moisture barrier layer. The second polymeric layer 42 is located between the inner surface 44 of the cellulose based layer 40 and the heat sealable polymeric layer 41. Preferably, the second polymeric layer 42 has a basis weight comprised between 5 grams per square meter and 10 grams per square meter.

Figure 7:
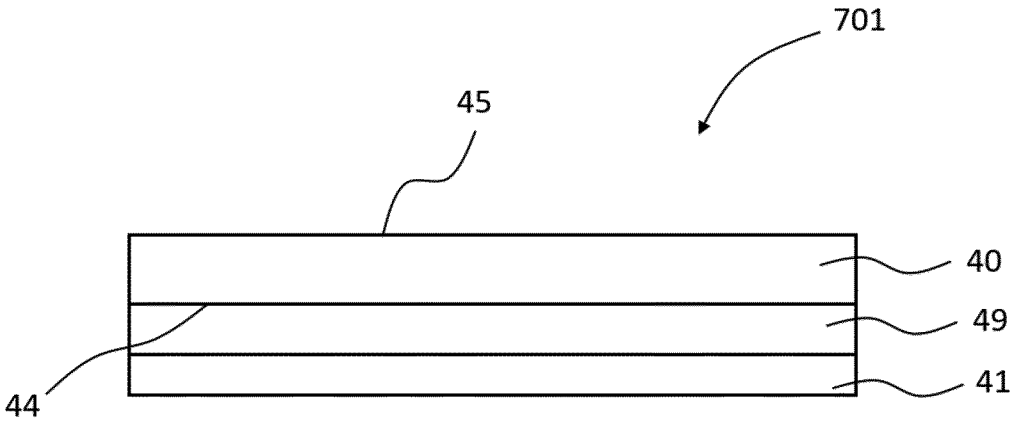
FIG. 7 shows an enlarged side view of the outer wrapper of FIG. 4 according to a third embodiment.

In a third embodiment shown in FIG. 7, the outer wrapper 701 comprises a cellulose based layer 40 comprising a cellulosic material, a metallized layer 49 and a heat sealable polymeric layer 41 having heat sealing properties. The cellulose based layer 40 has an inner surface 44 and an outer surface 45. The metallized layer 49 is provided on the inner surface 44 of the cellulose based layer 40. The heat sealable polymeric layer 41 covers the metallized layer 49 completely. The metallized layer may have a thickness of at least 10 nanometres, preferably, the metallized layer has a thickness of at least 15 nanometres. A primer layer (not shown) may be between the cellulose based layer 40 and the metallized layer 49. The primer layer may smoothen the surface of the cellulose based layer 40 and provide a suitable anchoring layer for the deposition of the metallized layer 49. A protective layer (not shown) may cover the metallized layer 49. The protective layer may protect the metallized layer 49 from damage that may occur during handling and forming of the container 1.

Figure 8:
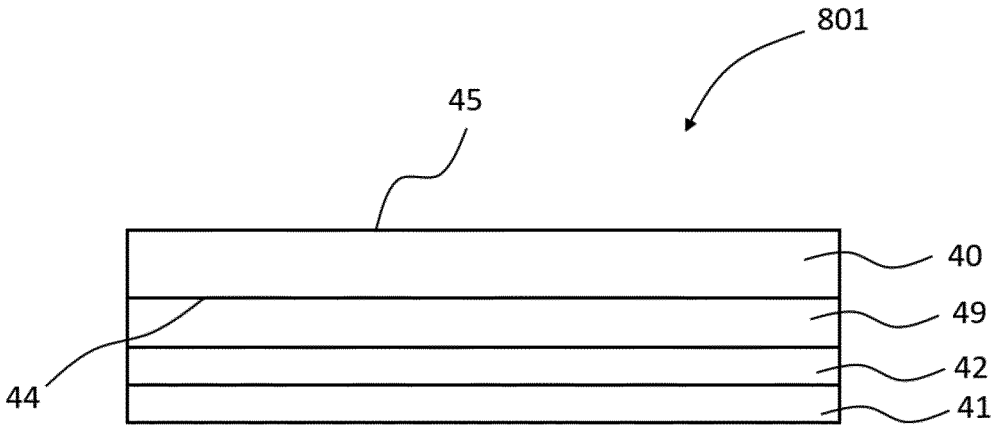
FIG. 8 shows an enlarged side view of the outer wrapper of FIG. 4 according to a fourth embodiment.

In a fourth embodiment shown in FIG. 8, the outer wrapper 801 comprises a cellulose based layer 40 comprising a cellulosic material, a metallized layer 49, a heat sealable polymeric layer 41 having heat sealing properties and a second polymeric layer 42.

The cellulose based layer 40 has an inner surface 44 and an outer surface 45. The metallized layer 49 is provided on the inner surface 44 of the cellulose based layer 40. The heat sealable polymeric layer 41 covers the metallized layer 49 completely. The metallized layer may have a thickness of at least 10 nanometres, preferably, the metallized layer has a thickness of at least 15 nanometres. A primer layer (not shown) may be between the cellulose based layer 40 and the metallized layer 49. The primer layer may smoothen the surface of the cellulose based layer 40 and provide a suitable anchoring layer for the deposition of the metallized layer 49. A protective layer (not shown) may cover the metallized layer 49. The protective layer may protect the metallized layer 49 from damage that may occur during handling and forming of the container 1. The second polymeric layer 42 is located between the metallized layer 49 and the heat sealable polymeric layer 41. Preferably, the second polymeric layer 42 has a basis weight comprised between 5 grams per square meter and 10 grams per square meter.

Figure 9:
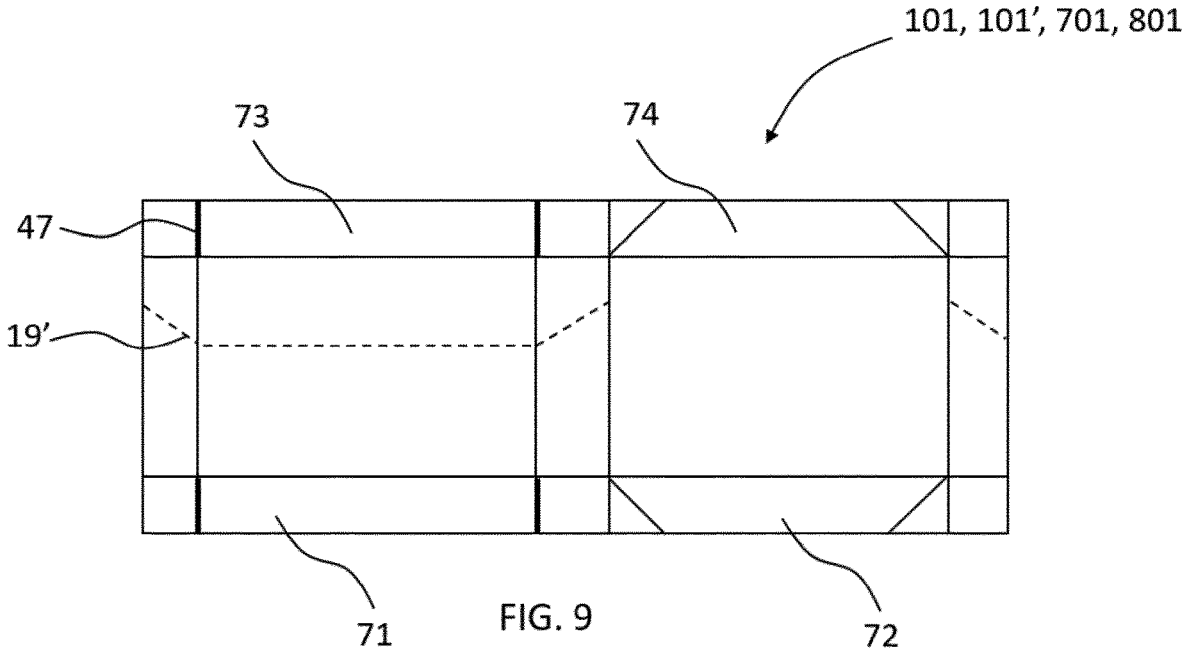
FIG. 9 shows a more detailed front view of the outer wrapper of FIGS. 4 to 6.

FIG. 9 is a more detailed front view of the outer wrapper 101, 101', 701, 801 of FIGS. 4 to 8. The first portion 71 and third portion 73 forming the rectangular folds of the outer wrapper are shown along with the second portion 72 and fourth portion 74 forming the envelope folds of the outer wrapper. The cut lines 47 in the outer wrapper which define the edges of the first portion 71 and the third portion 73 are also shown. As shown on the outer wrapper 101 or 101', a line of weakness 19' is formed. The line of weakness 19' is formed on the outer wrapper 101, 101' in such a way that, when the outer wrapper 101, 101' is wrapped around the housing 10, the line of weakness 19' is congruent to the opening line 19, as it is visible in FIGS. 15 to 17.

In order to form the container 1, the outer wrapper formed by the outer wrapper 101 is wrapped around the housing 10 as shown in FIGS. 10 to 19.

The line of weakness 19' may be manufactured with a laser scoring process or partial mechanical cutting of the cellulose based layer 40 over its thickness without damaging the heat sealable and moisture barrier layers.

The line of weakness 19' is formed on the cellulose based layer 40. The scoring is done on the outer surface 45 of the cellulose based layer 40 which becomes the outer surface of the container 1. The depth of the scoring is controlled in order not to impact the moisture barrier properties of the second polymeric layer 42 or the heat sealable properties of the first polymeric based layer 41.

Considering the scoring tolerances for both laser and mechanical processes and to have good functionality and ease of opening, the scoring depth is preferably between 50 percent to 80 percent of the thickness of the cellulose based layer 40. For laser scoring, a 1000 watt $CO_2$ laser may be used. Beam control of the laser may take place through a scanner. The process may be reel-to-reel with a speed of 200 meters/minute.

In case of mechanical scoring, a rotary cutting unit may be used. The operation is performed inserting the second cellulose based layer between knife of the cutting unit and a blind counter roller. Distance between the knife and counter roller may be between 15 micrometers to 30 micrometers depending on the substrate.

In FIGS. 10 to 19 only the outer wrapper 101 is shown, however the same process applies to the outer wrappers 101', 801 and 901.

Figures 10, 11, 12, 13, 14, 15, 16, 17, 18, 19:
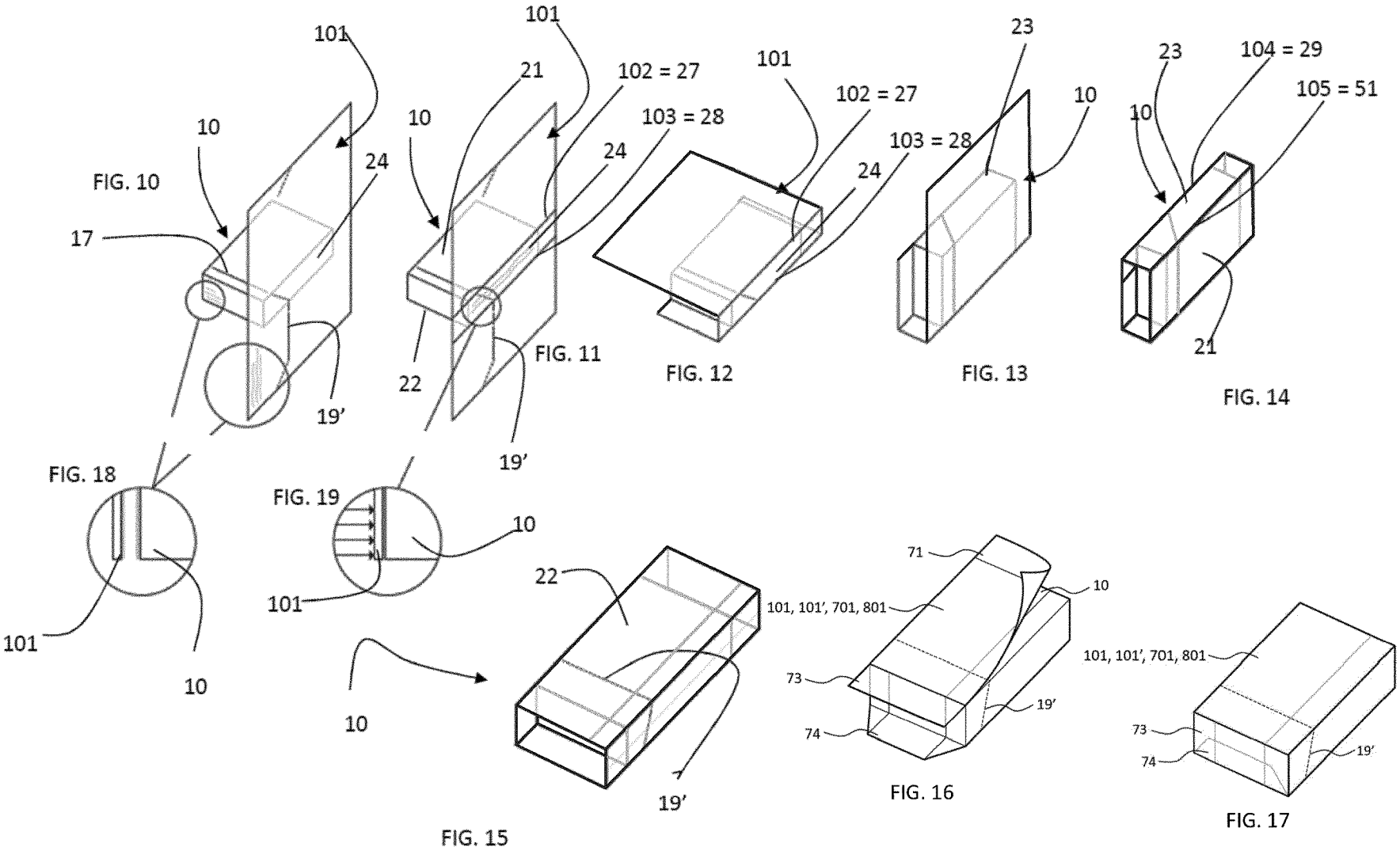
FIGS. 10 to 17 show perspective views of the steps of the method of forming the container of FIG. 1.
FIG. 18 shows a schematic enlarge view of a detail of FIG. 8.
FIG. 19 shows a schematic enlarged view of a detail of FIG. 9.

As shown in FIG. 10, the outer wrapper 101 is put in abutment with the right side wall 24 of the housing 10. The outer wrapper 101 is positioned in such a way that the heat sealable polymeric layer 41 contacts the housing 10 at the right side wall 24. The heat sealable polymeric layer 41 is thus the inner layer of the outer wrapper 101.

The enlarged view in FIG. 18 (corresponding to the circled features of FIG. 10) shows how the outer wrapper 101 is applied to the housing 10, putting the outer wrapper 101 into contact with the housing 10. Two fold lines 102, 103 are formed in the outer wrapper 101, corresponding to the location of the first and second right edges 27, 28 of the housing 10. This is depicted in FIG. 11. The outer wrapper 101 is then compressed against the side wall 24 as depicted by the arrows in FIG. 19 (which corresponds to the circled portion of FIG. 11).

FIG. 12 shows the outer wrapper 101 being folded at the two fold lines 102, 103, so that the front wall 22 and back wall 21 of the housing 10 are also in contact with the outer wrapper 101.

The housing 10 is then preferably re-oriented in order to facilitate wrapping, for example the left side wall 23 may now face upwards, as shown in FIG. 13.

Two additional fold lines are then formed in the outer wrapper 101, fold lines 104, 105, corresponding to the location of the first and second left edges 29, 51. The outer wrapper 101 is then folded at the two fold lines 104, 105 and two opposite flaps of the sheet blank overlap on the left side wall 23. This is depicted in FIG. 14. A panel of outer wrapper 101 is formed on the left side wall 23, right side wall 24, front wall 22 and back wall 21 of housing 10. In this way, the whole opening line 19 and the hinge line 17 are covered by the outer wrapper 101.

The housing 10 and outer wrapper 101 are then preferably re-oriented, so that the front wall 22 now faces upwards, as shown in FIG. 15.

FIGS. 16 and 17 show the outer wrapper 101 being folded to cover the ends 25 and 26 of the housing. The outer wrapper 101 is folded in a known manner called "envelope folding" to form the second portion 72 and the fourth portion 74 which are envelope folds. The second portion 72 and the fourth portion 74 are then folded to abut and partially cover the ends 25 and 26 of the housing 10 respectively. The outer wrapper 101 is then folded to form the first portion 71 and the third portion 73 which are rectangular folds. The first portion and the third portion are then folded such that they abut the ends 25 and 26 of the housing respectively. The first portion 71 and the third portion 73 overlie the second portion 72 and the fourth portion 74 respectively and fully cover the ends 25 and 26 of the housing 10. In FIG. 17, the whole housing 10 is covered by the outer wrapper 101, which forms a panel on each wall of the housing 10. The line of weakness 19' is congruent to the opening line 19 which it overlies.

Figure 20:
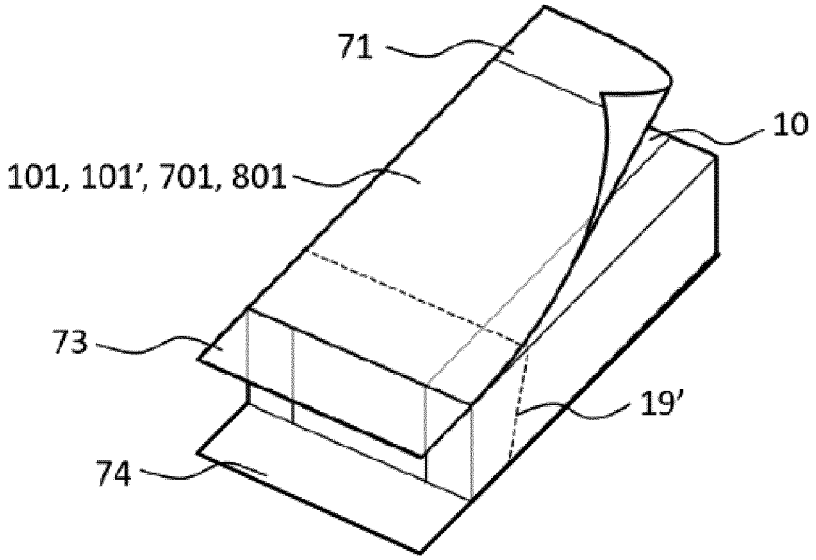
FIG. 20 shows a perspective view of a step used in a method of forming the container of FIG. 21.
Figure 21:
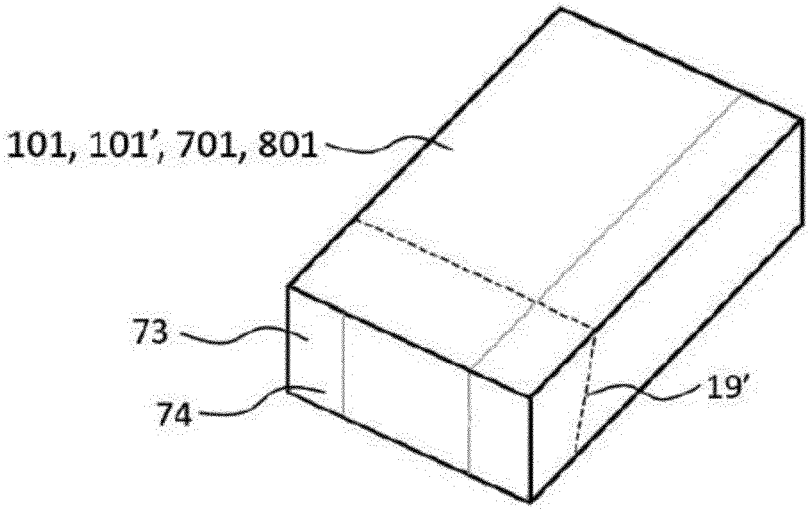
FIG. 21 shows a perspective view of a container according to a fifth embodiment.

FIGS. 20 and 21 show the outer wrapper 101 being folded to cover the ends 25 and 26 of the housing in an alternative configuration to that of FIGS. 16 and 17. The outer wrapper 101 is folded to form the second portion 72 and fourth portion 74 which are rectangular folds. The second portion and the fourth portion 74 are the folded to abut and cover the ends 25 and 26 of the housing 10 respectively. The outer wrapper is then folded to form the first portion 71 and the third portion 73 which are also rectangular folds. The first portion and the third portion are then folded such that they abut the ends 25 and 26 of the housing 10 respectively. The first portion 71 and the third portion 73 overlie the second portion 72 and the fourth portion 74 respectively and fully cover the ends 25 and 26 of the housing 10.

In FIG. 21, the whole housing 10 is covered by the outer wrapper 101, which forms a panel on each wall of the housing 10. The line of weakness 19' is congruent to the opening line 19 which it overlies.

Heat and pressure is applied to fix and join the outer wrapper 101 to the housing 10. For example, a temperature of 110 degrees Celsius, and a pressure of 1 Newton per square centimetre ($N/cm^2$) are applied for a time of 100 milliseconds. These conditions provides a satisfactory seal and high adhesion.

The invention claimed is:

1. A container for consumer goods, the container comprising:

a housing configured for consumer goods;

an outer wrapper having an inner surface and an outer surface, the outer wrapper comprising a cellulose based layer, wherein the outer wrapper is wrapped around the housing such that a first portion of the outer wrapper overlies a second portion of the outer wrapper at a first end of the housing to cover the first end of the housing, wherein the first portion of the outer wrapper forms a rectangular fold, wherein the outer wrapper further comprises a heat-sealable polymeric layer provided at least on the inner surface of the first portion of the outer wrapper, and wherein the heat-sealable polymeric layer is sealed onto the first end of the housing.

2. The container for consumer goods according to claim 1, wherein the first portion of the outer wrapper is formed by two cuts in the outer wrapper.

3. The container for consumer goods according to claim 1, wherein the first portion of the outer wrapper has a shape and size that is the same as a shape and size of the first end of the housing.

4. The container for consumer goods according to claim 1, wherein the second portion of the outer wrapper forms an envelope fold or a rectangular fold.

5. The container for consumer goods according to claim 1, wherein the outer wrapper is wrapped around the housing such that a third portion of the outer wrapper overlies a fourth portion at a second end of the housing to cover the second end of the housing, and wherein the third portion of the outer wrapper forms a rectangular fold.

6. The container for consumer goods according to claim 1, wherein the heat-sealable polymeric layer is provided on an inner surface of a third portion to seal the outer wrapper at a second end of the housing.

7. The container for consumer goods according to claim 1, wherein the heat-sealable polymeric layer is on at least 50 percent of the inner surface of the outer wrapper.

8. The container for consumer goods according to claim 1, wherein the container is a hinge lid box comprising a box portion and a lid portion connected to the box portion along a hinge line extending across a back wall of the container, the hinge lid container being formed by the housing and the outer wrapper being sealed on the housing.

9. The container for consumer goods according to claim 8, wherein the lid portion and the box portion are separated by an opening line extending across one or more walls of the container, and wherein the opening line is defined by a line of weakness in one or both of the housing and the outer wrapper.

10. The container for consumer goods according to claim 9, wherein the line of weakness in one or both of the housing and the outer wrapper includes an etched line having a depth not greater than 80 percent of a thickness of one or both of the housing and the outer wrapper.

11. The container for consumer goods according to claim 1, wherein the heat-sealable polymeric layer is a first heat-sealable polymeric layer and the outer wrapper further comprises a second polymeric layer or a metallized layer.

12. The container for consumer goods according to claim 11, wherein the second polymeric layer or the metallized layer is provided between the cellulose based layer and the first heat-sealable polymeric layer.

13. The container for consumer goods according to claim 11, wherein one or both of the first or second polymeric layer comprises a composition comprising one or more of a polymer or copolymer of ethylene, a polymer or copolymer of propylene, a copolymer of styrene acrylate, a copolymer of styrene butadiene, a copolymer of styrene isoprene, a copolymer of hydrogenated styrene butadiene, a copolymer of hydrogenated styrene isoprene, a copolymer of an ester of acrylic or methacrylic acid, and a copolymer of vinyl acetate.

14. The container for consumer goods according to claim 11, wherein the second polymeric layer extends across the entire inner surface of the outer wrapper.

15. The container for consumer goods according to claim 1, wherein the first portion of the outer wrapper depends from a fold line of a first wall of the outer wrapper.

16. The container for consumer goods according to claim 15, wherein the second portion of the outer wrapper depends from a fold line of a second wall of the outer wrapper.

17. The container for consumer goods according to claim 16, wherein the second wall of the outer wrapper is opposite to the first wall.

18. The container for consumer goods according to claim 16, wherein the second wall of the outer wrapper is a back wall.

19. The container for consumer goods according to claim 15, wherein the first wall of the outer wrapper is a front wall.

20. The container for consumer goods according to claim 1, wherein the first portion of the wrapper fully overlies the first end of the housing.

21. The container for consumer goods according to claim 1, wherein at the first end of the housing, the outer wrapper consists of the first portion of the outer wrapper and the second portion of the outer wrapper.

22. The container for consumer goods according to claim 1, wherein the first portion of the outer wrapper fully overlies the second portion of the outer wrapper.

23. The container for consumer goods according to claim 1, wherein each of the first portion and second portion depends from a respective fold line.

24. The container for consumer goods according to claim 1, wherein at the first end of the housing, the outer wrapper consists of the first portion and the second portion, each of which depends from a respective fold line, and wherein the outer wrapper is wrapped around the housing such that the first portion of the outer wrapper fully overlies the second portion of the outer wrapper at a first end of the housing to cover the first end of the housing.

25. A method of forming a container for consumer goods, the method comprising the steps of:

providing a housing configured for consumer goods;

providing an outer wrapper, the outer wrapper comprising a cellulose based layer, wherein a heat-sealable polymeric layer is provided at least on an inner surface of a first portion of the outer wrapper;

folding the outer wrapper around the housing such that a first portion of the outer wrapper overlies a second portion of the outer wrapper at a first end of the housing to cover the first end of the housing, wherein the first portion forms a rectangular fold; and heating the housing and the outer wrapper to seal the heat-sealable polymeric layer on the housing, wherein the step of heating the housing and the outer wrapper includes heating the outer wrapper to form a seal at the first end of the container.

26. The method according to claim 25, wherein the step of heating the housing and the outer wrapper comprises heating the housing and the outer wrapper while applying pressure, to seal the outer wrapper on the housing.

* * * * *